United States Patent [19]

Meininger et al.

[11] Patent Number: 4,693,726

[45] Date of Patent: Sep. 15, 1987

[54] PROCESS FOR DYEING OR PRINTING CELLULOSE FIBERS OR CELLULOSE BLEND FIBERS WITH PYRIDINIUM-TRIAZINE REACTIVE DYE, AXABLE WITHOUT ALKALI

[75] Inventors: Fritz Meininger, Frankfurt am Main; Peter Mischke, Bad Soden am Taunus; Gerd König, Hofheim am Taunus; Hartmut Springer, Königstein/Taunus, all of Fed. Rep. of Germany

[73] Assignee: Hoechst Aktiengesellschaft, Fed. Rep. of Germany

[21] Appl. No.: 847,722

[22] Filed: Apr. 3, 1986

[30] Foreign Application Priority Data

Apr. 6, 1985 [DE] Fed. Rep. of Germany ..... 3512630

[51] Int. Cl.[4] ..... D06P 1/38; D06P 3/66; C09B 62/04

[52] U.S. Cl. ..... 8/547; 8/531; 8/532; 8/534; 8/541; 8/549; 8/662; 8/677; 8/680; 8/686; 8/687; 8/918; 534/630

[58] Field of Search ..... 8/549, 547, 541, 532

[56] References Cited

U.S. PATENT DOCUMENTS

| | | | |
|---|---|---|---|
| 3,416,875 | 12/1968 | Ponzini et al. | 8/918 |
| 3,519,614 | 7/1970 | Ponzini | 8/543 |
| 4,453,945 | 6/1984 | Miyamoto et al. | 8/543 |

FOREIGN PATENT DOCUMENTS

| | | |
|---|---|---|
| 946998 | 1/1964 | United Kingdom . |
| 1005240 | 9/1965 | United Kingdom . |
| 1012625 | 12/1965 | United Kingdom . |

*Primary Examiner*—A. Lionel Clingman
*Attorney, Agent, or Firm*—Connolly and Hutz

[57] ABSTRACT

Process for dyeing cellulose fibers or cellulose blend fibers, which comprises dyeing the fibers mentioned with water-soluble reactive dyes which contain in the dye molecule at least once the structural element of the formula (1)

in which Y denotes a hydroxyl, hydroxymethyl, alkoxy $C_1$–$C_4$, aldehyde, carboxamide, monoalkyl $C_1$–$C_4$-carboxamide, dialkyl $C_1$–$C_4$-carboxamide, monophenyl carboxamide, cyano, alkyl $C_1$–$C_4$-oxycarbonyl or sulfo group or a halogen atom, in an aqueous medium within the pH range 4–11.

18 Claims, No Drawings

PROCESS FOR DYEING OR PRINTING CELLULOSE FIBERS OR CELLULOSE BLEND FIBERS WITH PYRIDINIUM-TRIAZINE REACTIVE DYE, AXABLE WITHOUT ALKALI

The invention relates to a process for dyeing or printing cellulose fibers or cellulose blend fibers with water-soluble reactive dyes having a certain structural element. In the case of fiber blends, the process according to the invention is suitable in particular for the one-bath dyeing of blends of cellulose and polyester fibers with combinations of water-soluble reactive dyes containing a certain structural element and disperse dyes.

The use of dyes which contain a pyridinium radical or a methyl-substituted pyridinium radical bonded to the dye radical via the s-triazine ring for dyeing textile materials, in particular cellulose fiber materials, is known from German Offenlegungsschrift No. 1,419,859, German Pat. No. 1,209,544, British Pat. Nos. 946,998, 1,005,240 and 1,012,625. Herein the dyes are applied in conjunction with the use of acid-binding agents, such as sodium carbonate, sodium hydroxide, trisodium phosphate or sodium metasilicate, i.e. in an alkaline medium, at temperatures of 0° to 100° C.

The dyeing of cellulose fiber materials with reactive dyes which contain bonded to the dye radical via the s-triazine ring a pyridinium radical which is substituted in the 3-position by a carboxyl group or a sodium carboxylate group in the presence of acid-binding agents such as hydroxides, carbonates or alkali metal triphosphates, at temperatures of 30° to 90° C. is known from German Offenlegungsschrift Nos. 1,544,352 and 1,544,356.

Compared with the reactive dyes used according to the invention, the dyes used in the processes of the previously cited references have distinct disadvantages with respect to their lower affinity when dyeing cellulose fiber materials by the exhaust method.

The use of reactive dyes which contain bonded to the dye radical via the s-triazine ring a pyridinium radical which is substituted in the 3-position by a carboxyl or alkali metal carboxylate group for dyeing cellulose fibers, or together with disperse dyes, for dyeing cellulose blend fibers, such as cellulose/polyester blend fibers, by a one-bath method within the pH range 4–10 at temperatures of 95°–150° C. is described in German Offenlegungsschrift No. 3,314,663.

Compared with the dyes used in this known process, the fixation optimum of the reactive dyes used according to the invention is not located in the alkaline region but preferably around the neutral region, as a result of which they are more suitable, in mixture with disperse dyes, for the one-bath dyeing of cellulose/polyester fiber blends. As a result it is possible to avoid the damage to disperse dyes which is caused by the alkaline agents customarily required in the one-bath dyeing method for fixing the reactive dyes and which manifests itself in shade deviations, reduced fastness level and loss of tinctorial strength. In addition, it is possible to prevent the simultaneously used reactive dyes from undergoing increased hydrolysis in the alkaline range within the temperature range 110°–140° C., which is required for dyeing the polyester fiber portion with disperse dyes, and avoid incurring a reduced dyeing yield.

It has been found that cellulose fibers or cellulose blend fibers can be dyed very advantageously by dyeing the stated fibers with water-soluble reactive dyes which contain in the dye molecule at least once the structural element of the formula (1)

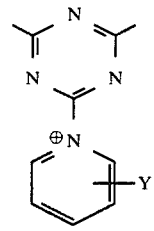

(1)

in which Y denotes a hydroxyl, hydroxymethyl, alkoxy $C_1$–$C_4$, aldehyde, carboxamide, monoalkyl $C_1$–$C_4$-carboxamide, dialkyl $C_1$–$C_4$-carboxamide, monophenyl carboxamide, cyano, alkyl $C_1$–$C_4$-oxycarbonyl or sulfo group or a halogen atom, for example a chlorine or bromine atom, in an aqueous medium within the pH range 4–11.

The blend with the cellulose fibers can contain not only synthetic fibers, such as, for example, polyester, polyamide, acid-modified acrylic fibers or cellulose triacetate fibers, but also natural fibers, such as, for example, silk or wool, and the fiber materials can be present in any desired form, for example as fibers, filaments, hanks or fabrics.

In the dyeing of blend fibers which, in addition to the cellulose fiber, contain natural fibers, such as, for example, silk or wool, or which contain synthetic polyamide fibers, both the cellulose fiber portion and the portion of natural fibers or synthetic polyamide fibers is dyed alone by the (acid) reactive dyes used according to the invention.

To dye cellulose fibers made of, for example, regenerated cellulose, linen or in particular cotton, or cellulose fibers blended with silk or wool, the reactive dyes having the structural element of the stated formula (1) can be applied not only by the exhaust method at temperatures of about 30°–90° C., preferably about 40°–80° C., but also by the padding method at temperatures of expediently about 20°–50° C., the cellulose fiber or cellulose blend fiber to be dyed dictating the optimum dyeing temperature to be used in each case. In dyeing by the padding method, the fiber material is impregnated with aqueous dye solutions which may contain salt, and the dyes are subsequently fixed, with or without heating.

To dye blend fibers which, in addition to cellulose fiber, contain synthetic fibers, such as polyester or acid-modified acrylic fibers, or cellulose triacetate fibers, the reactive dyes mentioned are used together with the dyes which are suitable for the synthetic fibers, for example disperse dyes in the case of blend fibers of cellulose and polyester or cellulose triacetate fibers being present, within the temperature range from about 95° C. to about 150° C. at pH values between about 4 and 8, the addition of alkaline agents not being necessary in general. To maintain a well defined pH value, it is advisable to add a suitable buffer system. Since dyes having a structural element of the formula (1) can also be fixed without alkaline agents, the process according to the invention can be used to dye cellulose/polyester or cellulose/cellulose triacetate blend fibers simultaneously from one bath without it being possible for the simultaneously used disperse dyes to be damaged.

To dye blend fibers of cellulose fibers and acid-modified acrylic fibers, the reactive dyes mentioned are used together with cationic dyes.

To carry out the process according to the invention for dyeing blends of cellulose fibers and polyester or cellulose triacetate fibers, the two categories of dye (reactive and disperse dyes) are conventionally dissolved and predispersed respectively and are added to the aqueous dyeing liquor together with the amount of electrolyte which is customary for the exhaust method. The pH value of the dyeing liquor is set to a pH value between 4 and 8.

The dyeing liquor containing the material to be dyed is then heated up, and dyeing takes place at 95° C. to 150° C., preferably 110° C. and 135° C., for 30 to 90 minutes, or dyeing is first carried out with a dyeing liquor containing a disperse dye and, for example 20 minutes before the end of the dyeing process, the solution of the reactive dye is metered into the ongoing high-temperature dyeing process.

The dyeings obtained by the process according to the invention are subjected to a thorough rinse with cold and hot water, with or without addition of an agent which acts like a dispersant and promotes the diffusion of the unfixed portions.

Suitable for dyeing cellulose fibers or the cellulose fiber portion and, if present, the other, non-synthetic fiber portion of fiber blends by the process according to the invention are, as already stated, reactive dyes which contain the structural element of the formula (1) one or more times, preference being given to those dyes which are distinguished by a high affinity for cellulose fiber.

Examples of reactive dyes suitable for the process according to the invention are those of the following formulae:

(2)

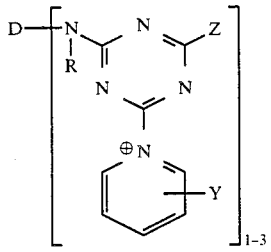

(3)

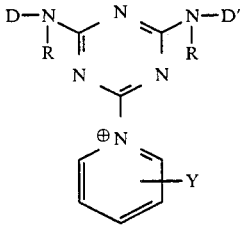

(4)

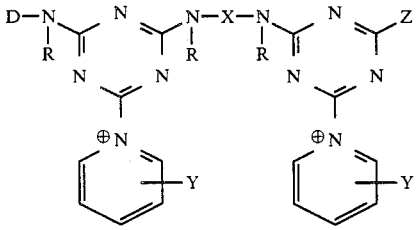

-continued (5)

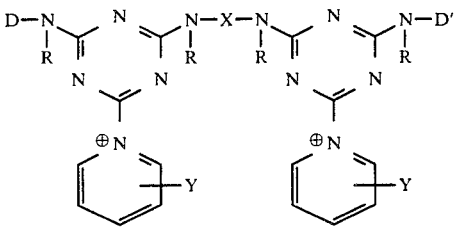

(6)

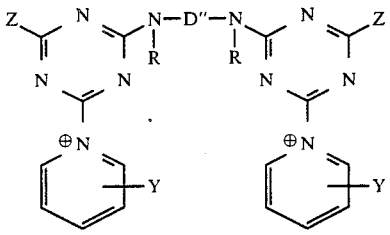

(7)

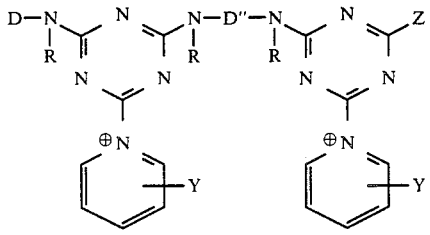

in which D, D′ and D″ denote radicals of an organic dye of the monoazo, polyazo, metal complex azo, formazan, anthraquinone, phthalocyanine, dioxazine, phenazine, azomethine, xanthene, pyrenequinone or perylenetetracarbimide series, R denotes a hydrogen atom or a substituted or unsubstituted alkyl $C_1$–$C_4$ group, X denotes an aliphatic araliphatic or aromatic diamine radical, Y denotes a hydroxyl, cyano, hydroxymethyl, alkoxy $C_1$–$C_4$, aldehyde, carboxamide, monoalkyl $C_1$–$C_4$-carboxamide, dialyl $C_1$–$C_4$-carboxamide, monophenylcarboxamide or alkyl $C_1$–$C_4$-oxycarbonyl group, for example the methyloxycarbonyl, ethyloxycarbonyl, n-propyloxycarbonyl or i-propyloxycarbonyl group, and also a sulfo group or a halogen atom, for example a chlorine or bromine atom, and Z denotes an unsubstituted, mono- or di-substituted amino group, an alkoxy $C_1$–$C_4$ or phenoxy group.

The dye radicals D and D′ of the general formulae (3) and (5) can be identical (D=D′) or different from each other (D≠D′).

The dye radicals D, D′ and D″ of the general formulae (2) to (7) can be substituted in conventional manner, in particular by one or more sulfo groups. Examples of further substituents are alkyl groups having 1 to 4 carbon atoms, such as in particular methyl, ethyl, n- or i-propyl; alkoxy groups having 1 to 4 carbon atoms, such as methoxy, ethoxy, propoxy and butoxy; acylamino groups having 1 to 4 carbon atoms, such as in particular acetylamino, propionylamino; the amino group, alkylamino groups having 1 to 4 carbon atoms, phenylamino and alkoxycarbonyl groups having 1 to 4 carbon atoms in the alkoxy radical; and also hydroxyl, carboxyl, sulfo, nitro, cyano, carbamoyl, sulfamoyl and ureido groups as well as halogen atoms, such as, for example, chlorine or bromine atoms.

R in the formulae (2) to (7) can be a straight-chain or branched alkyl $C_1$–$C_4$ radical which can be substituted, for example by hydroxyl, sulfo, sulfato or cyano groups. Examples of R are methyl, ethyl, sulfomethyl, β-hydroxyethyl, β-hydroxypropyl, β-sulfoethyl, β-sulfatoethyl and β-cyanoethyl.

Suitable intermediate members X in the general formulae (4) to (5) are radicals of a diamine, such as, for example the following:

$\leftarrow CH_2 \rightarrow_n$ where n = 2 to 6, and the hydrocarbon chain can also be interrupted by hetero atoms such as O, S and N,

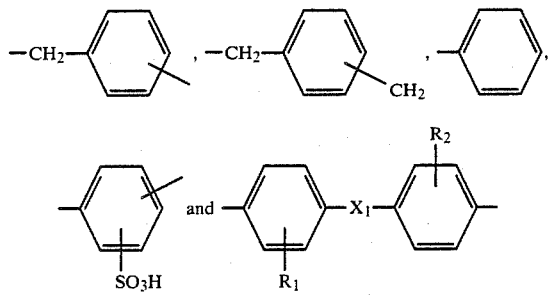

where $R_2$ denotes $-SO_3H$, $-Cl$, $-Br$ or $-O$alkyl having 1 to 4 carbon atoms and $X_1$ denotes a direct bond or the groups $-CH_2-$; $-CH_2CH_2$; $-NH-$; $-CONH-$; $-CO-$; $-O-$; $-S-$; $-SO_2-$; $-NHCONH-$; $-NHCSNH-$ and $-CH=CH-$.

Suitable substituents Z in the general formulae (2), (4), (6) and (7) are the amino group and alkyl $C_1$–$C_4$ amino groups, in which the alkyl groups can be substituted, for example by hydroxyl, methoxy, carboxyl, sulfato, sulfo, cyano, alkyl $C_1$–$C_4$-amino or di(alkyl) $C_1$–$C_3$-amino, and the alkyl radicals can in turn be substituted, for example by hydroxyl, methoxy and sulfato, and one alkyl radical in di(alkyl $C_1$–$C_3$)-amino can be substituted by hydroxyl, methoxy, sulfo, sulfato, carboxyl and halogen, such as chlorine and bromine, and further radicals of cyclic amines such as piperidino, morpholino and piperazino, anilino, the last named optionally substituted by alkyl $C_1$–$C_4$, alkoxy $C_1$–$C_4$, chlorine, carboxyl, sulfo and nitro; substituents Z can also be alkoxy $C_1$–$C_4$-groups which can be substituted by alkoxy $C_1$–$C_4$ such as methoxy, ethoxy or propoxy, and also the phenoxy groups which can be substituted, for example by methyl, chlorine, sulfo, carboxyl or nitro.

Specific examples of the substituents Z are the following groups:

amino, methyl, ethyl, n- and i-propyl and n- and i-butylamino, β-hydroxyethyl, β-methoxyethyl, β-carboxyethyl, β-sulfatoethyl, β-sulfoethyl, β-cyanoethyl, carboxymethyl, β-dimethylaminoethyl, γ-dimethylaminopropyl, β-hydroxypropyl and β-sulfatopropylamino, dimethyl, diethyl, diethanol, methyl-β-hydroxyethylamino, methyl-β-methoxyethylamino, methyl-β-sulfoethylamino, methyl-β-sulfatoethylamino, methyl-β-carboxyethylamino, methylcarboxymethylamino and methyl-β-chloroethylamino, anilino, o-, m- or p-toluidino, o- m- or p-methoxyanilino, o-, m- or p-chloroanilino, o-, m- or p-carboxyanilino, 2,4- and 2,5-dicarboxyanilino, o-, m- or p-sulfoanilino, 2,4- and 2,5-disulfoanilino, m-nitroanilino-, 2-methyl- and 2-methoxy-4-sulfoanilino, 4-chloro- and 4-methyl-2-sulfoanilino, N-methylanilino, N-methyl-m-toluidino, N-methyl-p-sulfoanilino, N-ethylanilino, N-β-hydroxyethylanilino and N-β-hydroxyethyl-m-toluidino, further methoxy, ethoxy, propoxy, butoxy, methoxyethoxy, methoxypropoxy, ethoxyethoxy and propoxy, ethoxy, phenoxy, o-, m- and p-chlorophenoxy, o-, m- and p-sulfophenoxy, o-, m- and p-carboxyphenoxy or p-nitrophenoxy.

The dyes of the stated general formulae (2) to (7) can be prepared for example by reacting the corresponding halogenotriazine dyes, where the halogen stands for fluorine, chlorine or bromine, with pyridine derivatives in aqueous solution within the temperature range from about 40° C. to 120° C. within the weakly acid to alkaline pH range (pH about 5 to 9).

Examples of suitable pyridine derivatives are as follows:

pyridine-3-carboxamide, pyridine-4-carboxamide, methyl pyridine-3-carboxylate, ethyl pyridine-3-carboxylate, methyl and ethyl pyridine-4-carboxylates, pyridine-3-carbonitrile, pyridine-4-carbonitrile, 3- and 4-chloropyridine, 3- and 4-bromopyridine, 3- and 4-methoxypyridine, pyridine-3-sulfonic acid, pyridine-3- and -4-aldehyde, dimethylnicotinamide, diethylnicotinamide, dimethylisonicotinamide, diethylisonicotinamide, 3- and 4-hydroxypyridine and 3- and 4-(hydroxymethyl)-pyridine.

In dye structures of the general formulae (2), (3), (4), (5) and (7) in which D and D′ denote the radicals of monoazo, polyazo or metal complex azo dyes, the reactive radical of the general formula (1) can be bonded either to the radical of the diazo component or to the radical of the coupling component.

In the case of D″ of the general formulae (6) and (7), the reactive radicals of the general formula (1) are bonded not only to the radical of the diazo component but also to the radical of the coupling component.

Preferred dye structures of D—N(R)—, D′—N(R)— and —(R)N—D″—N(R)— of the general formulae (2) to (7) are for example the following, where $n_1$ and $n_2$ can be zero or 1 and in the case of D and D′ either $n_1$ or $n_2$ is zero and in the case of D″ $n_1$ and $n_2$ each denote 1:

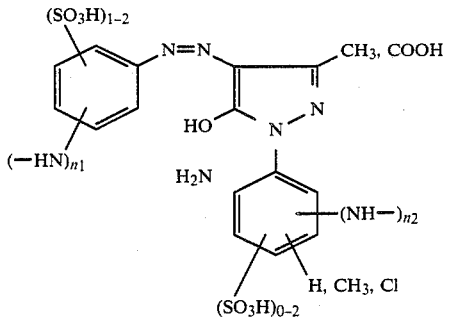

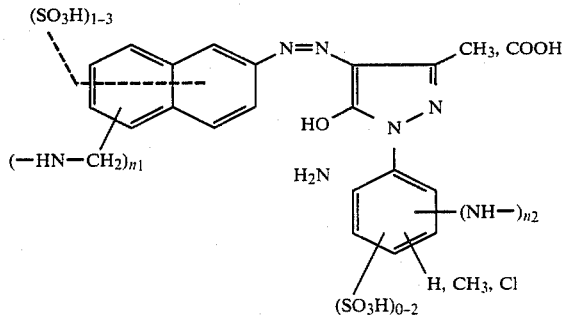

-continued
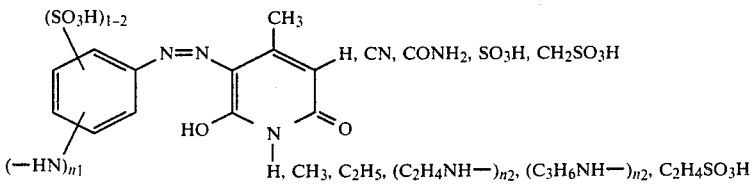
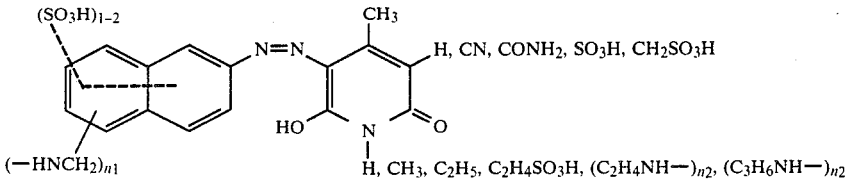
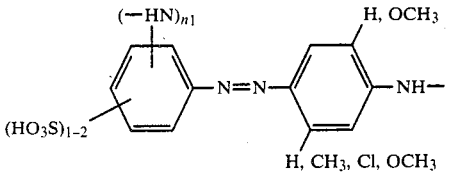
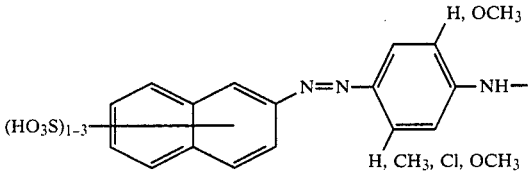
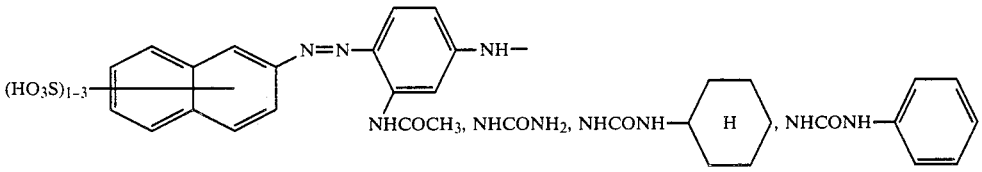
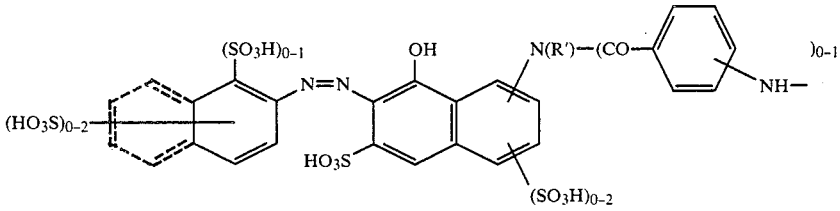
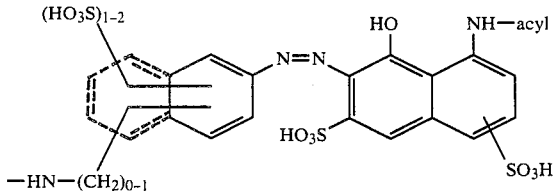
in which R'=H or $CH_3$, and acyl denotes for example acetyl or substituted or unsubstituted benzoyl.
Metal complexes of dyes of the following structures:

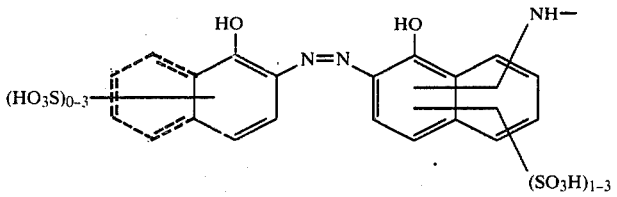
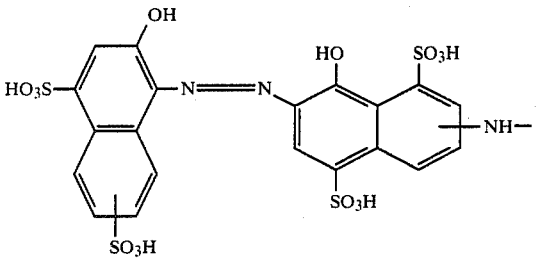
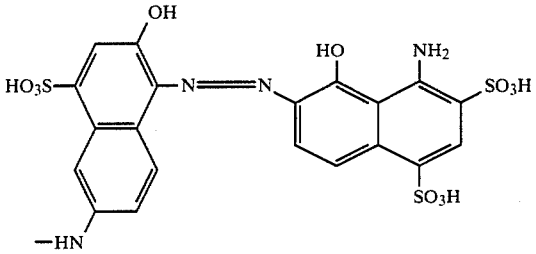
Of these, preference is given to 1:1 Cu complexes or 1:2 Cr and 1:2 Co complexes.
-continued
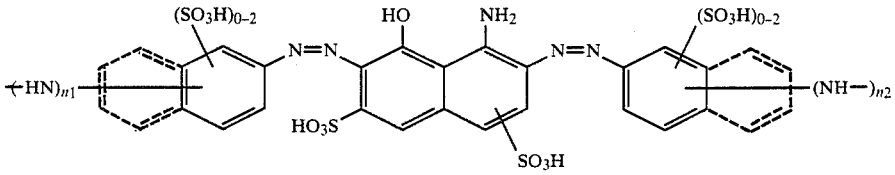
The ring systems indicated by broken lines are intended to symbolize alternatively possible naphthaline rings.
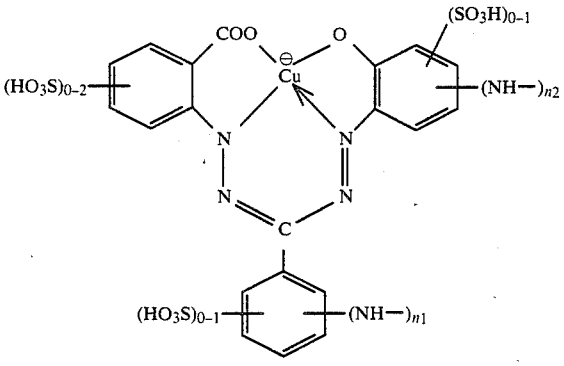
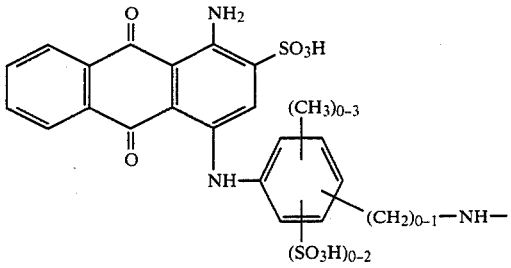
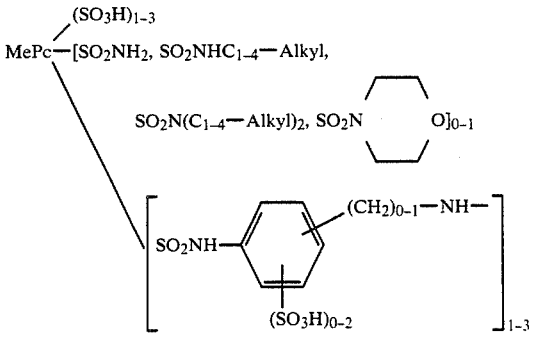

where MePc denotes the Cu or Ni phthalocyanine radical and the number of substituents on the metal phthalocyanine radical is on average 3 to 4.

Dioxazine dye radicals of the following structures:

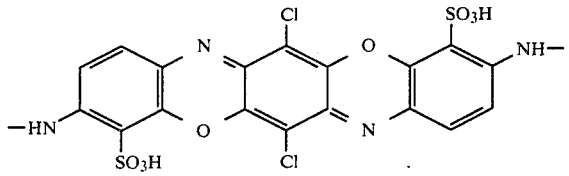

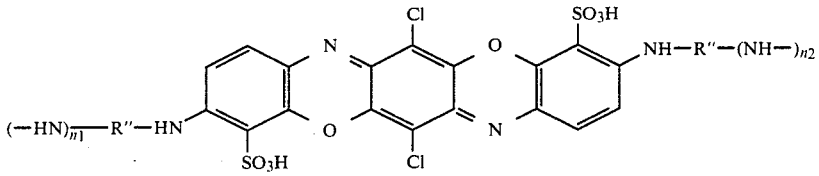

where R'' denotes an aliphatic or cycloaliphatic radical

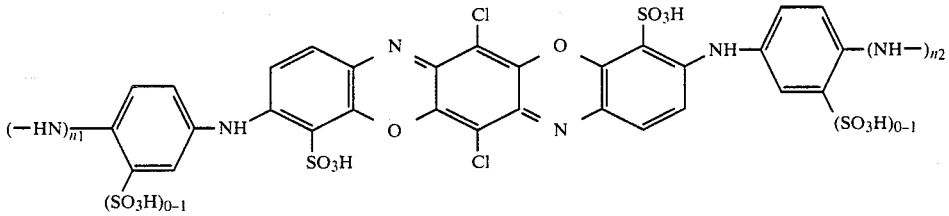

The dye radicals of all of the structures mentioned can be further substituted in the alkyl or aryl radicals, in particular by substituents mentioned in the characterization of D, D' and D''.

In a special variant, the dyeing process according to the invention can also be carried out by preparing the

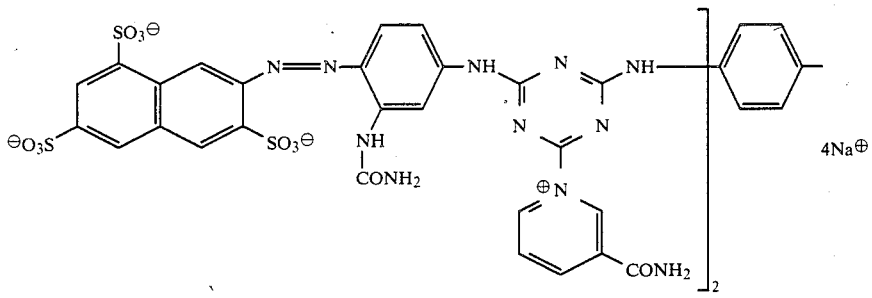

dyes of the general formulae (2) to (7) from the corresponding halogenotriazine-containing dyes and the pyridine derivatives mentioned in the dyebath within the pH range from 5 to 8 immediately before or during the dyeing process. "Halogenotriazine-containing dyes" is to be understood here as meaning those which contain a fluorine, chlorine or bromine atom on the s-triazinyl ring.

The dyeing liquors can contain the commonly customary additives, such as, for example, inorganic salts, such as alkali metal chlorides or alkali metal sulfates, or urea, and also dispersants and leveling assistants.

The dyeings prepared for the dyes according to the invention are distinguished by bright shades and by high dye-fiber bond stability, by good to very good light fastness and very good wet fastness properties, such as wash, water, crossdyeing and perspiration fastness properties, and also by good pleating fastness, hot press fastness and rub fastness.

The examples below will illustrate the invention without restricting it to the content of the examples.

The parts are by weight, and the temperatures are in degrees celsius.

EXAMPLE 1

A dyebath is prepared by dissolving 2 parts of the dye of the formula and 50 parts of $Na_2SO_4$ and 1 part of sodium m-nitrobenzenesulfonate in 900 parts of water.

50 parts of a cotton fabric are entered at 40° C. into the dyebath, followed after 45 minutes by 100 parts of solution which contains 2 parts of calcined sodium carbonate. The temperature of the dyebath is held at 60° C. for a further 45 minutes. The dyed cotton fabric is then rinsed, a soap off at the boil with a nonionic detergent for about 10 minutes is rinsed once more and is finally dried. The result obtained is a deep golden yellow dyeing having very good fastness properties.

EXAMPLE 2

2 parts of the reactive dye of the formula

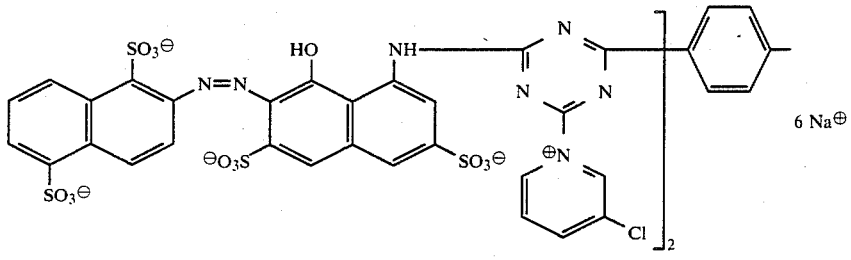

are dissolved in 200 parts of water. To the solution are added 800 parts of an aqueous solution which contains 50 parts of $Na_2SO_4$, and 2 parts of phosphate buffer (comprising $NaH_2PO_4$ and $Na_2HPO_4.12H_2O$) to bring the pH to a value of 6.5. 100 parts of cotton fabric are entered into this dyebath. The temperature is then raised under static pressure in the course of about 20 minutes to 125° C., and dyeing is continued at this temperature for 1 hour. The dyebath is then allowed to cool down.

The dyed cloth is subsequently rinsed with water, is soaped off at the boil with a nonionic detergent in the course of about 15 minutes, is rinsed once more with water and dried. The result obtained is a deep bluish red dyeing which has very good fastness properties.

EXAMPLE 3

A dyebath is prepared from 800 parts of water, 1 part of reactive dye of the following formula

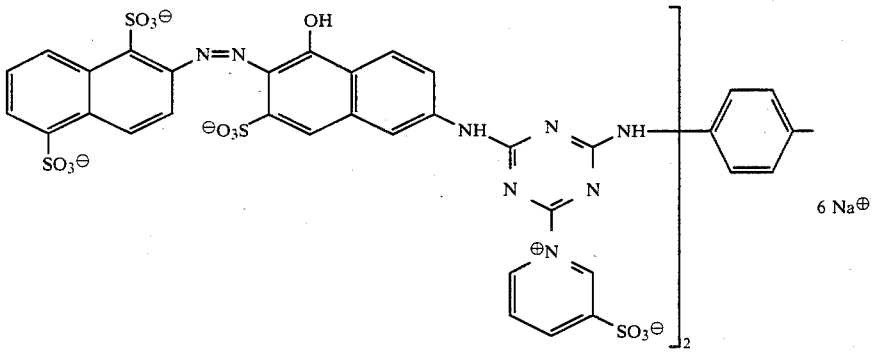

2 parts of C.I. Disperse Orange 25, 11 227, 20 parts of $Na_2SO_4$, 1 part of sodium m-nitrobenzenesulfonate and 2 parts of a dispersant customary with disperse dyes, such as ligninsulfonic acid.

The dyebath, which has been brought to pH 6.5, is entered at 40° C. with 100 parts of a cotton/polyester blend fabric (50:50), the liquor is rapidly heated under static pressure to the dyeing temperature of 130° C., and dyeing is carried out at that temperature for 1 hour. The dyeing thus produced is aftertreated in conventional manner by rinsing and soaping.

The result obtained is a vivid orange dyeing on the two fiber portions, which has good fastness properties.

The reactive dye of the abovementioned structure, used for dyeing the cotton portion, was prepared as follows:

15.7 parts of the chlorotriazine dye of the formula

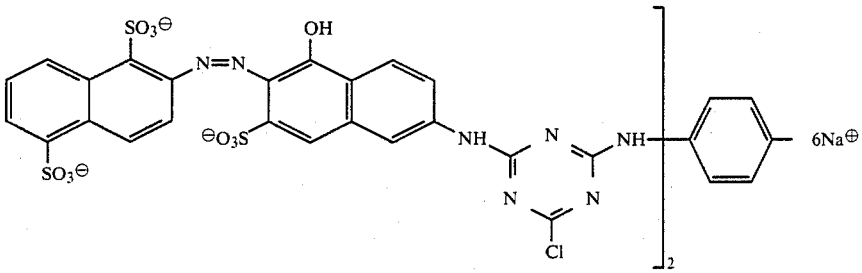

are suspended in 350 parts of water, and an alkaline solution of 2.1 parts of pyridin-3-sulfonic acid in 20 parts of water is added. With the pH value at 6.5 the temperature is raised to 80° C., and is maintained for 12 to 16 hours with stirring, the progress of the reaction being monitored by thin layer chromatography.

After the reaction has ended, the dye formed is salted out with sodium chloride at room temperature, is filtered off with suction, is washed with 5% strength sodium chloride solution and is dried.

The reactive dyes used in Examples 1 and 2 were prepared completely analogously by reacting the corresponding monochlorotriazine dyes with nicotinamide and 3-chloropyridine respectively.

EXAMPLE 4

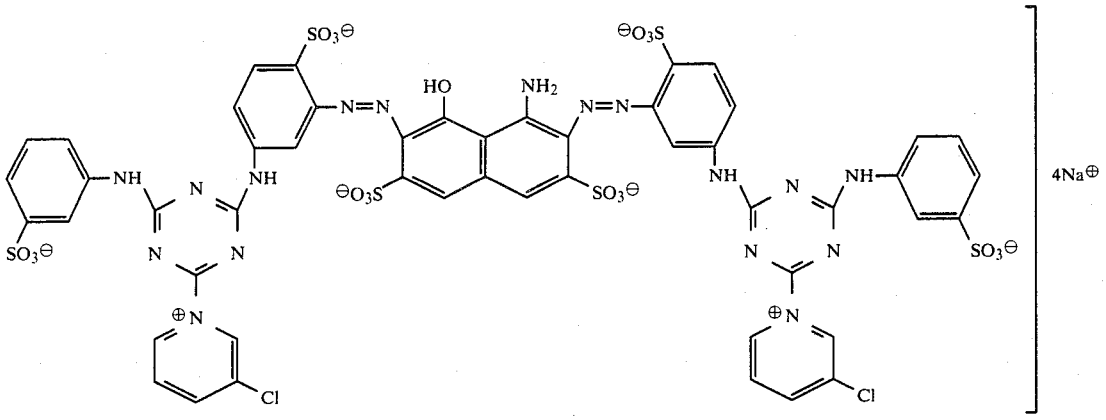

An HT dyeing machine is used to dye a blend fabric of 67% polyester fibers and 33% cotton in a liquor ratio of 1:20 with an aqueous liquor which contains, on weight of dry fiber, 1.5% of the disperse dye (in commercially available form and constitution) of the formula

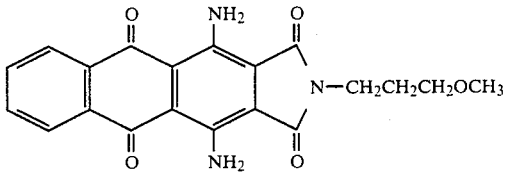

(C.I. Disperse Blue 87)

1.5% of the reactive dye of the formula

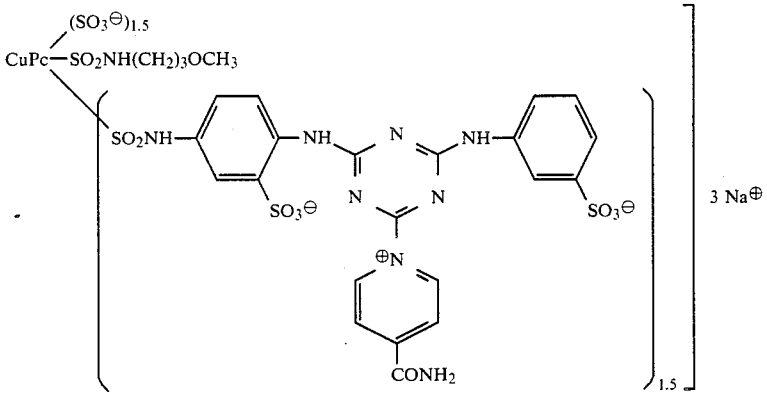

CuPc = copper phthalocyanine and 60 g/l sodium chloride. The dyeing liquor is brought to pH 6.0.

The textile material is dyed with this dyeing liquor at 130° C. for 1 hour. Customary rinsing and soaping leaves on the two fiber portions a vivid turquoise blue dyeing which has very good fastness properties.

To prepare the reactive dye, the monochlorotriazine dye is reacted with isonicotinamide at 80° C. in the course of 16 hours in accordance with Example 3.

EXAMPLE 5

An HT dyeing machine is used to dye mercerized cotton yarn cheeses in a liquor ratio of 1:20 with a liquor which contains an aqueous solution of 1% (on weight of dry fiber) of the reactive dye of the formula and 50 g/l of sodium chloride. The pH value is adjusted to 6.2 The dyebath is entered with the material to be dyed at room temperature, the liquor is raised to the dyeing temperature of 120° C., and the yarn is dyed at that temperature for about 1 hour. This is followed by cooling down, rinsing the resulting dyeing hot and cold with water and, finally, drying of the dyed cotton yarn. The result obtained is a deep navy dyeing which has good fastness properties.

EXAMPLE 6

A dyebath is prepared from 1100 parts of water, 1 part of the reactive dye described in Example 5, 3 parts of C.I. Disperse Blue 79 (commercially available form), 50 parts of $Na_2SO_4$ and 1 part of the sodium salt of m-nitrobenzenesulfonic acid and the pH value is adjusted to 6. A cotton/polyester blend fabric (50:50) is added, and the liquor is raised to the dyeing temperature of 130° C. 50 minutes of dyeing is followed by cooling down, and customary reduction cleaning leaves a deep navy dyeing on both fiber portions.

EXAMPLE 7

An HT dyeing machine is used to treat a polyester cotton (60:40) blend fabric in a liquor ratio of 1:20 with an aqueous liquor which, on weight of dry fiber, contains 1.5% of the disperse dye C.I. Disperse Blue 333 (commercially available form and constitution) and 40 g/l sodium chloride. The fiber blend is dyed in this liquor first at 130° C. for 45 minutes and an aqueous solution of, on weight of dry fiber, 1.5% of the reactive dye of the formula

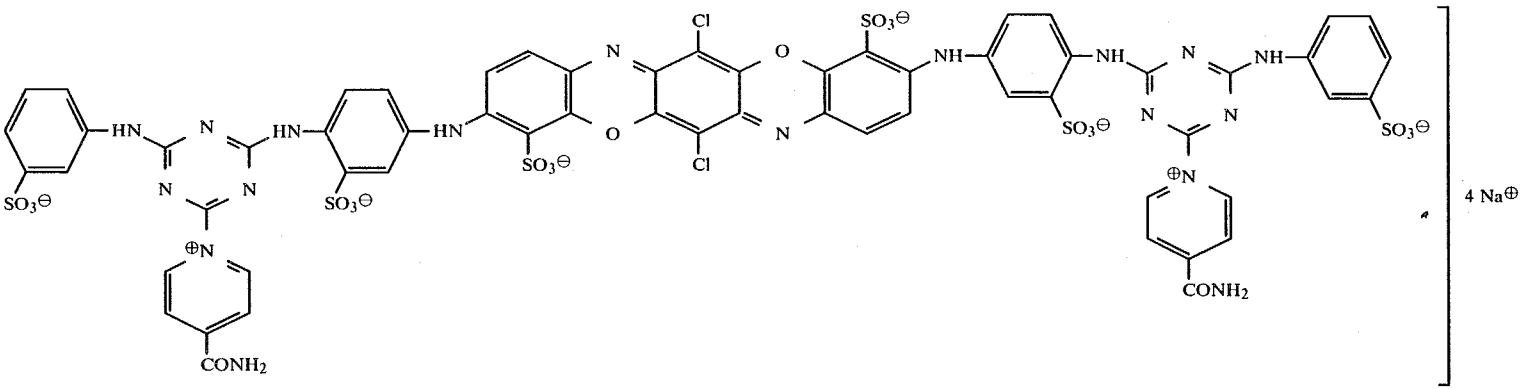

whose starting pH value is 7.5, is then added, and the textile material is dyed under these conditions for a further 45 minutes. The dyeing thus obtained is after-treated in conventional manner. A deep blue dyeing is obtained on both fibre portions.

EXAMPLE 8

A dyebath prepared from 900 parts of water, 1 part of the reactive dye of the formula

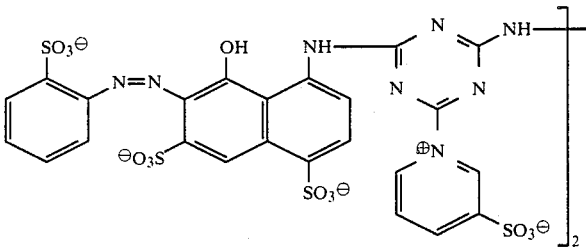

2 parts of C.I. Disperse Red 358 (commercially available form) and 50 parts of $Na_2SO_4$ and brought to a pH of 7.2 is used to dye a polyester/cotton blend fabric (50:50) at 135° C. for 45 minutes. Customary after-treatment leaves a deep bright red dyeing on both fiber portions.

EXAMPLE 9

A navy dyeing as obtained in Example 6 can also be prepared on a polyester/cotton blend fabric by carrying out the dyeing process in accordance with the instructions given there and using an aqueous liquor which, on weight of dry fiber, contains 1.8% of the dye C.I. Disperse Blue 56, 63 285,
0.5% of the dye C.I. Disperse Brown 1, 11 152,
0.5% of the dye C.I. Disperse Violet 48 (each in commercially available form and constitution) and
0.9% of the reactive dye mentioned in Example 5,
0.2% of the reactive dye of the formula

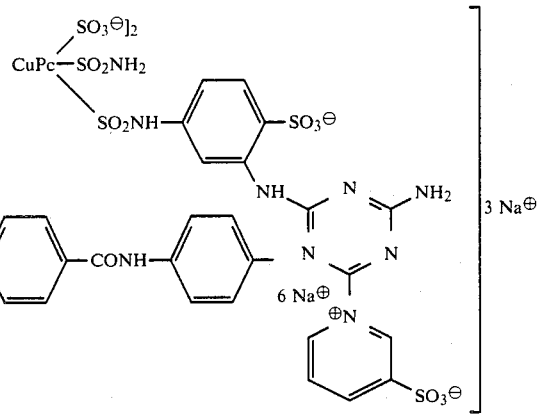

(CuPc = copper phthalocyanine)

and 60 parts of $Na_2SO_4$.

Equally good dyeings having similar fastness properties are also obtained with dyes which can be prepared by reacting the halogenotriazine dyes listed in the table below with the pyridine derivatives mentioned on page 6 analogously to Example 3.

| Example | Monohalogenotriazine dye | Hue on cellulose fibers |
|---|---|---|
| 10 | 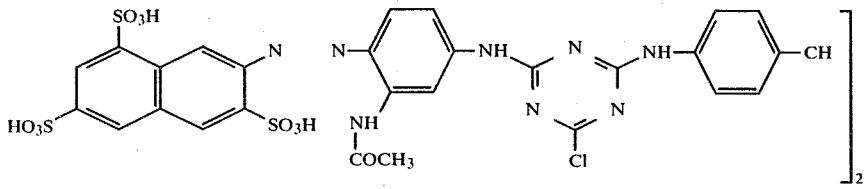 | reddish yellow |
| 11 | 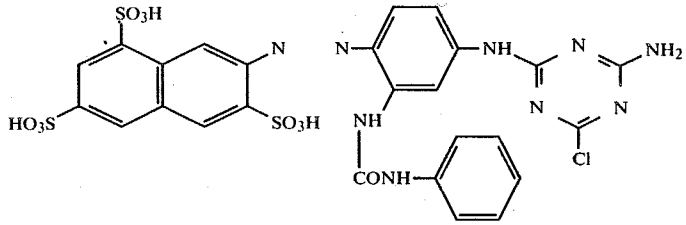 | reddish yellow |
| 12 | 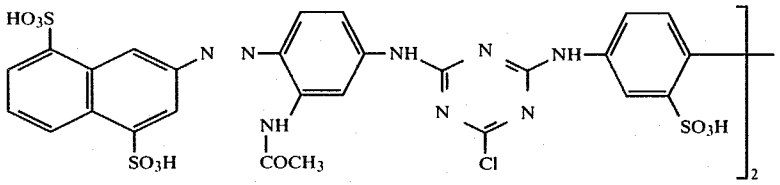 | reddish yellow |
| 13 | 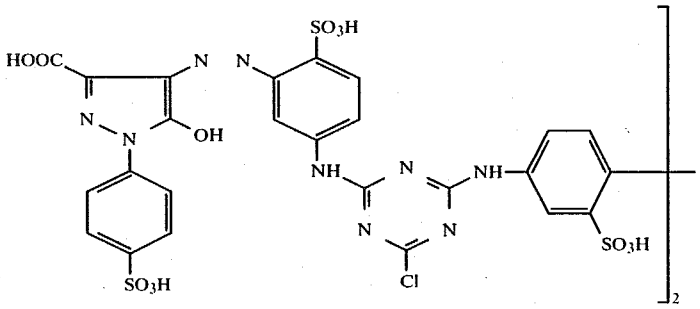 | yellow |

-continued
| Example | Monohalogenotriazine dye | Hue on cellulose fibers |
|---|---|---|
| 14 | 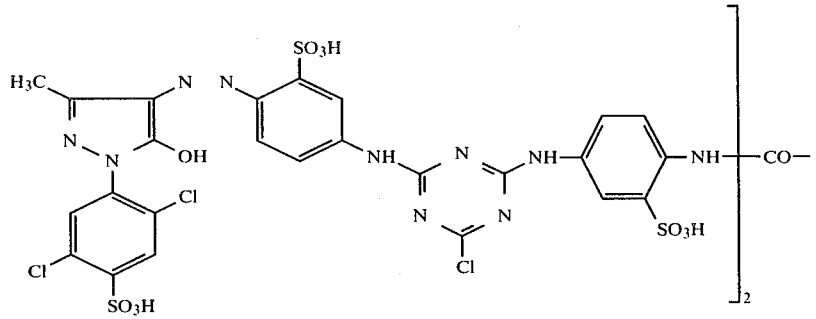 | yellow |
| 15 | 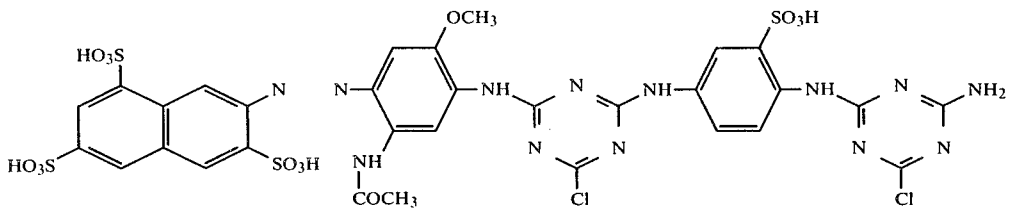 | reddish yellow |
| 16 | 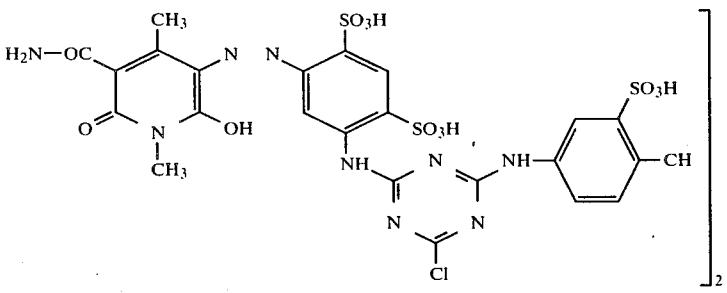 | greenish yellow |

-continued
| Example | Monohalogenotriazine dye | Hue on cellulose fibers |
|---|---|---|
| 17 | 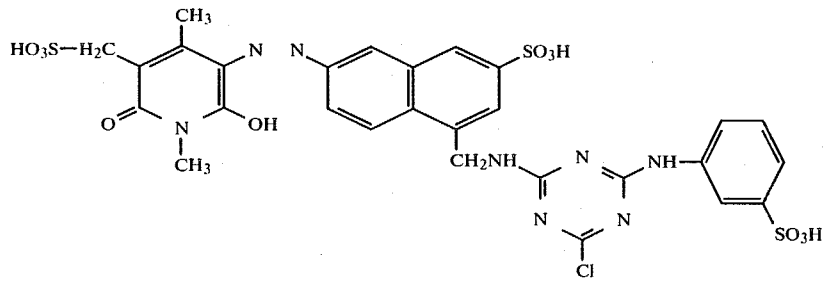 | yellow |
| 18 | 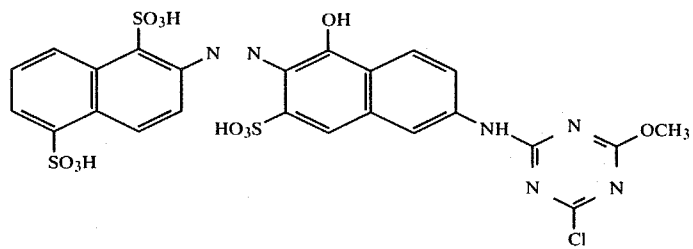 | orange |
| 19 | 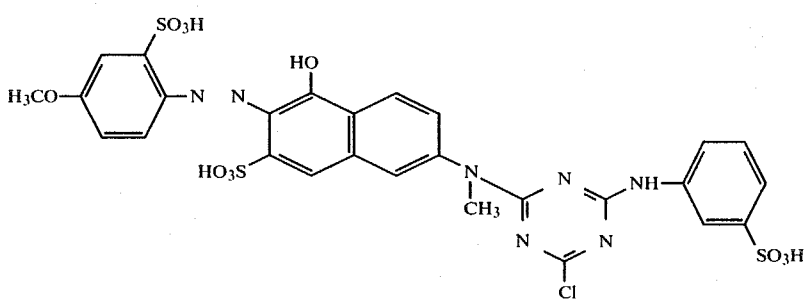 | scarlet |

-continued
| Example | Monohalogenotriazine dye | Hue on cellulose fibers |
|---|---|---|
| 20 | 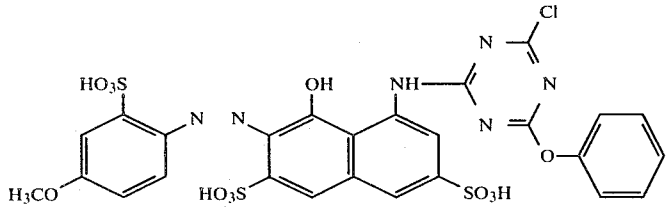 | blueish red |
| 21 | 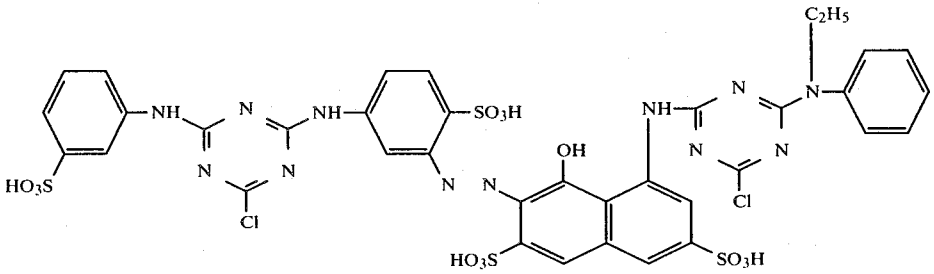 | red |
| 22 | 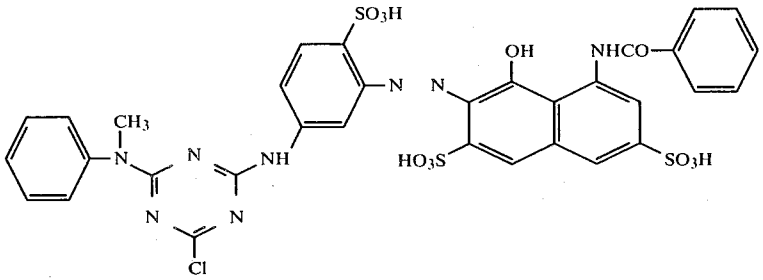 | red |
| 23 | 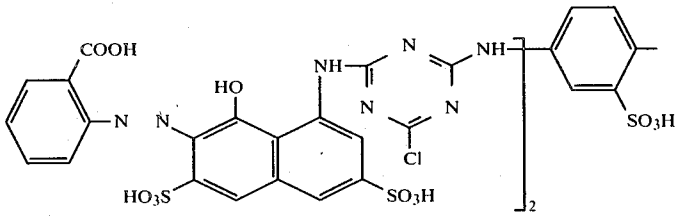 | red |

-continued
| Example | Monohalogenotriazine dye | Hue on cellulose fibers |
|---|---|---|
| 24 | 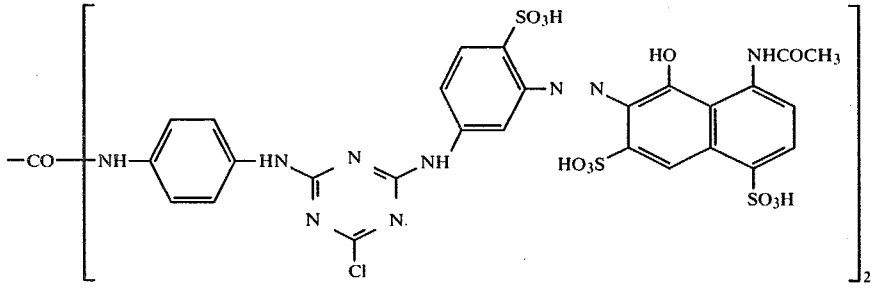 | red |
| 25 | 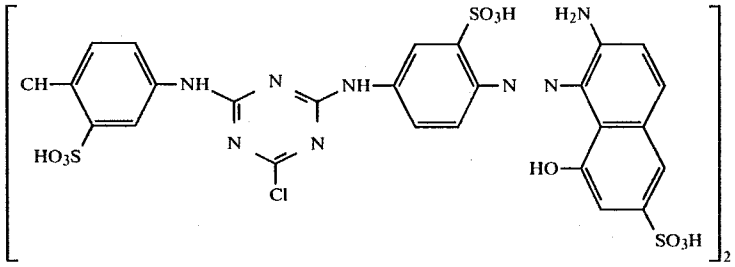 | blueish red |
| 26 | 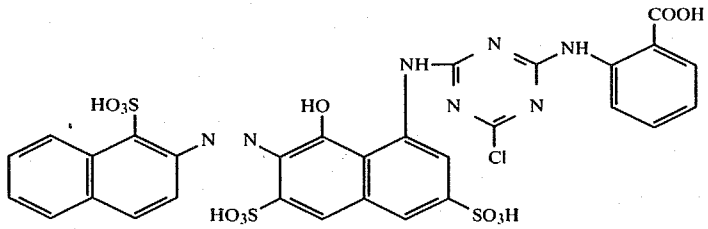 | blueish red |

-continued
| Example | Monohalogenotriazine dye | Hue on cellulose fibers |
|---|---|---|
| 27 | 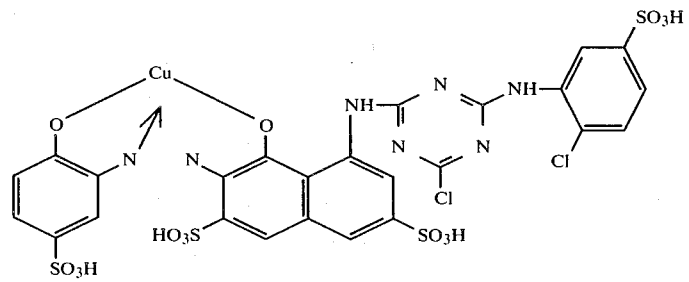 | violet |
| 28 | 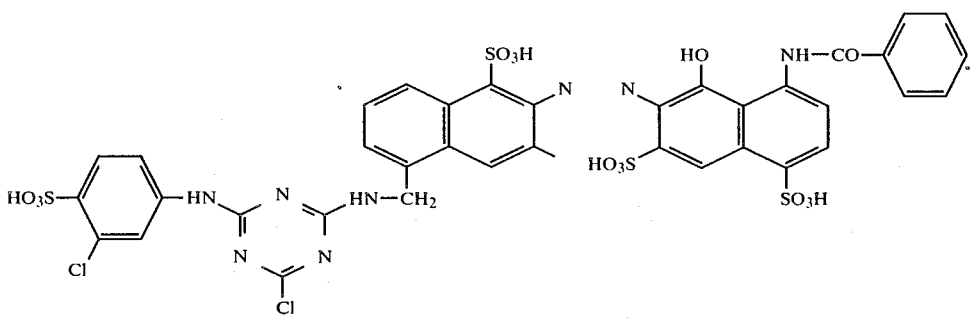 | bright red |

-continued
| Example | Monohalogenotriazine dye | Hue on cellulose fibers |
|---|---|---|
| 29 | 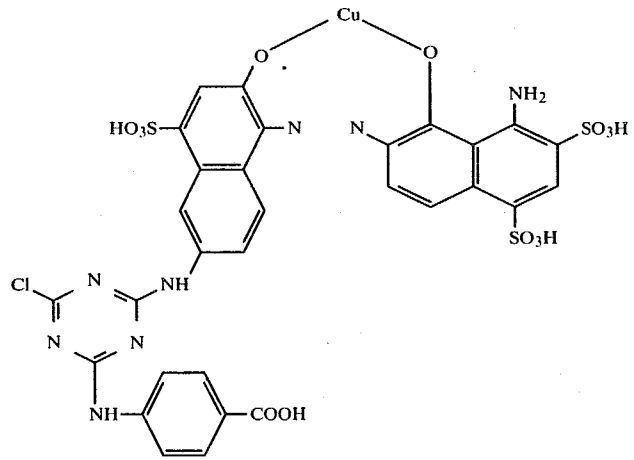 | blue |
| 30 | 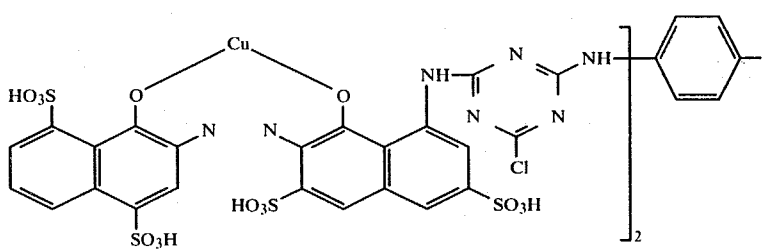 | blue |

-continued
| Example | Monohalogenotriazine dye | Hue on cellulose fibers |
|---|---|---|
| 31 | 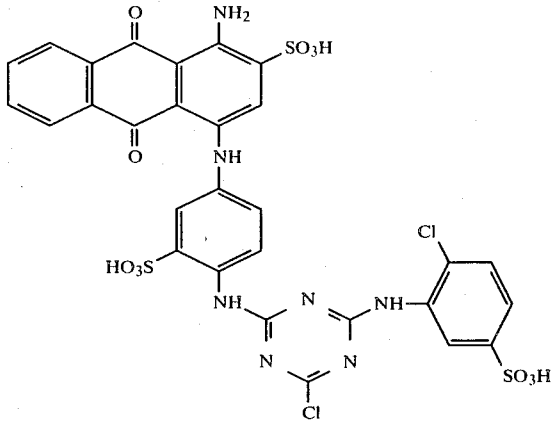 | bright blue |
| 32 | 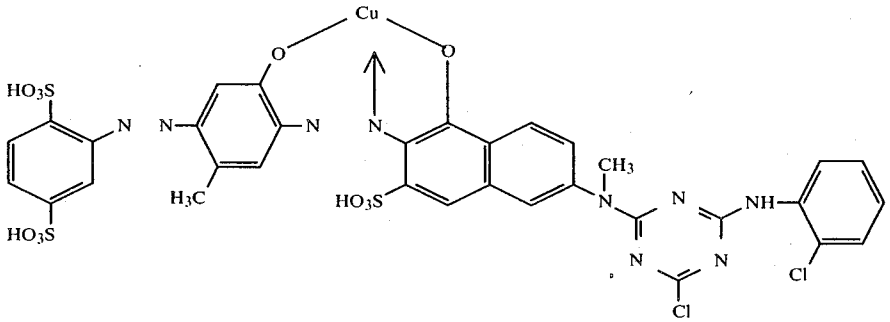 | navy blue |

-continued
| Example | Monohalogenotriazine dye | Hue on cellulose fibers |
|---|---|---|
| 33 | 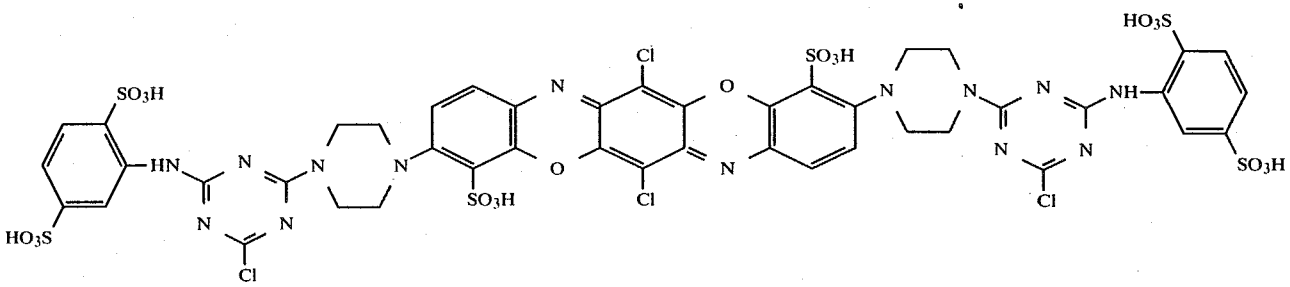 | blue |
| 34 | 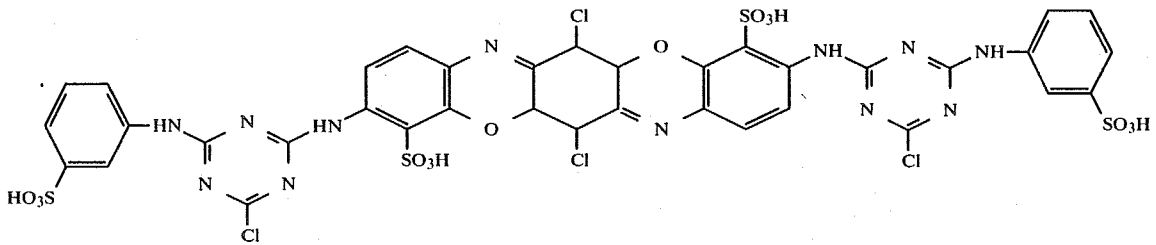 | reddish blue |
| 35 | 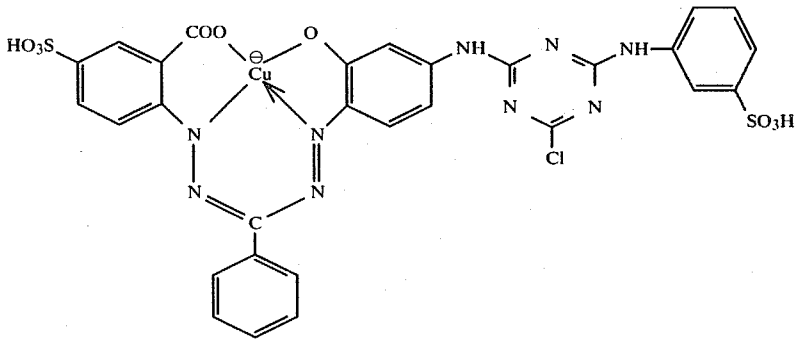 | blue |

-continued
| Example | Monohalogenotriazine dye | Hue on cellulose fibers |
|---|---|---|
| 36 | 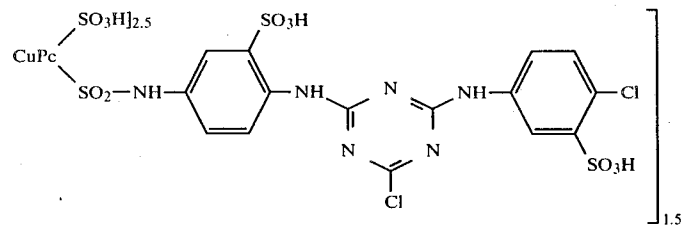 (CuPc = copper phthalocyanine) | turquoise blue |
| 37 | 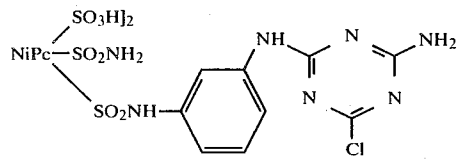 | blueish green |
| 38 | 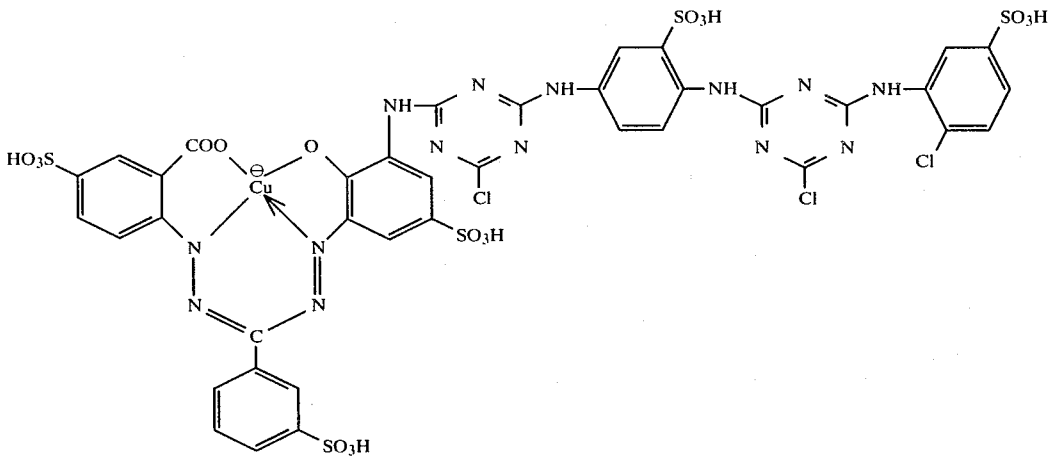 | blue |

-continued
| Example | Monohalogenotriazine dye | Hue on cellulose fibers |
|---|---|---|
| 39 | 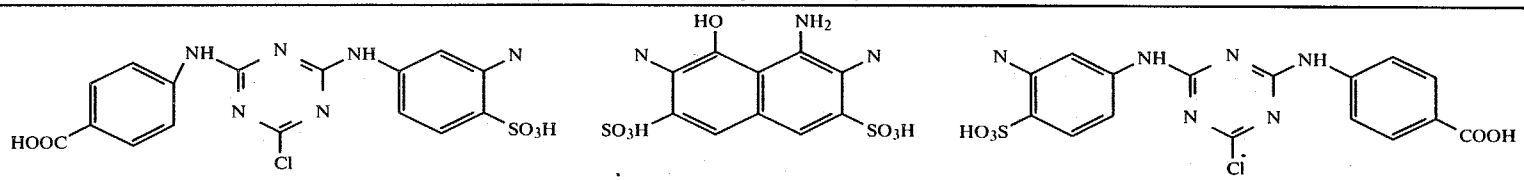 | navy or black |
| 40 | 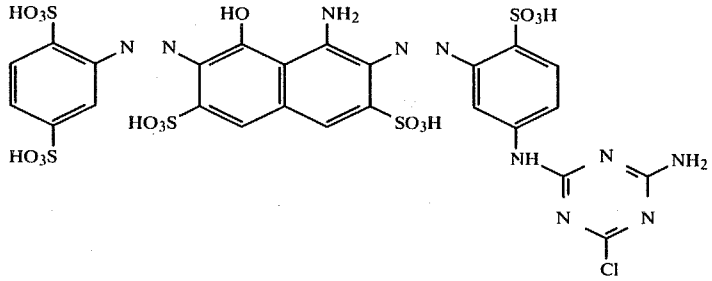 | navy or black |

EXAMPLE 41

A blend fabric of 67 parts of polyester fibers and 33 parts of cotton is printed with a print paste which contains per kg 30 g of tne oye Disperse Red of the C.I. No. 60 756,
30 g of the reactive dye of the formula

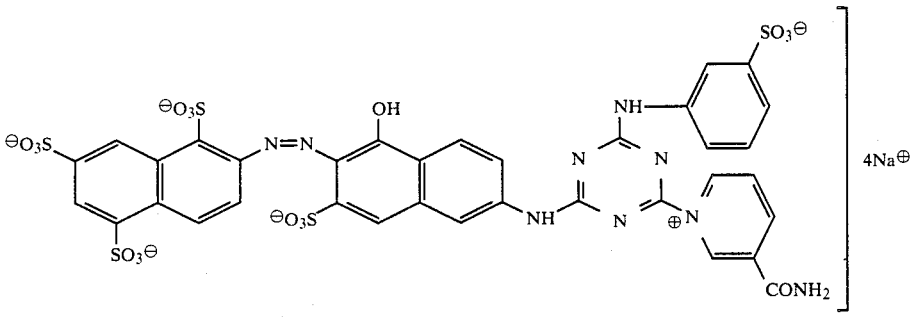

(the dye is in commercially available form and constitution), 600 g of 4% strength alginate thickening and 340 g of water
1000 g of print paste To fix the dye the fabric is steamed after printing at 130° C. for 5 minutes. The resulting print is then rinsed hot with water, is soaped off hot until neutral with an aqueous bath containing 0.5 g/l of a nonionic detergent for 5 minutes, is rinsed once more with water and is dried.

The results obtained are brilliant and level red prints with shot effect on both fiber portions.

EXAMPLE 42

A blend fabric of polyester fibers/cotton (67/33) is padded with a 70% liquor pickup (on weight of dry fiber) with an aqueous padding (liquor containing 18 g/l of the dye Disperse Blue 56 of C.I. No. 63 285,
5 g/l of the dye Disperse Brown 1 of C.I. No. 11 152,
5 g/l of the disperse dye of the formula

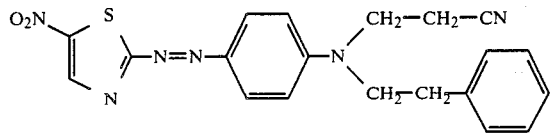

20 g/l of the reactive dye of the formula

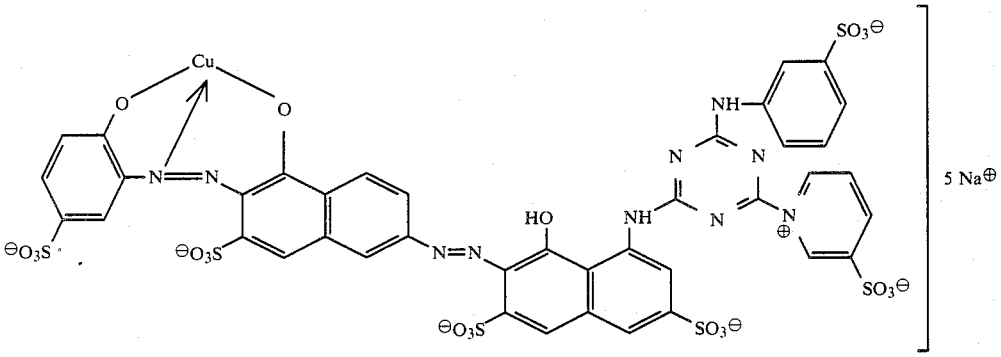

(the dye is in commercially available form and constitution) and 10 g/l of an assistant based on a mixture of alkyl- and aryl-oxyethylates.

To fix the dyes, the fabric is subsequently steamed at 125° C. with high-pressure steam for 10 minutes. The dyeing is then aftertreated at the boil for 10 minutes with an aqueous bath containing 0.5 g/l of the reaction product of 1 mol of nonylphenol with 8 mol of ethylene oxide.

The result obtained is a deep blue dyeing of the fabric with satisfactory tone-on-tone coverage of the two fiber portions.

EXAMPLE 43

A dyebath is prepared to comprise 250 parts of water, 20 parts of sodium sulfate and 0.5 part of the dye of the formula

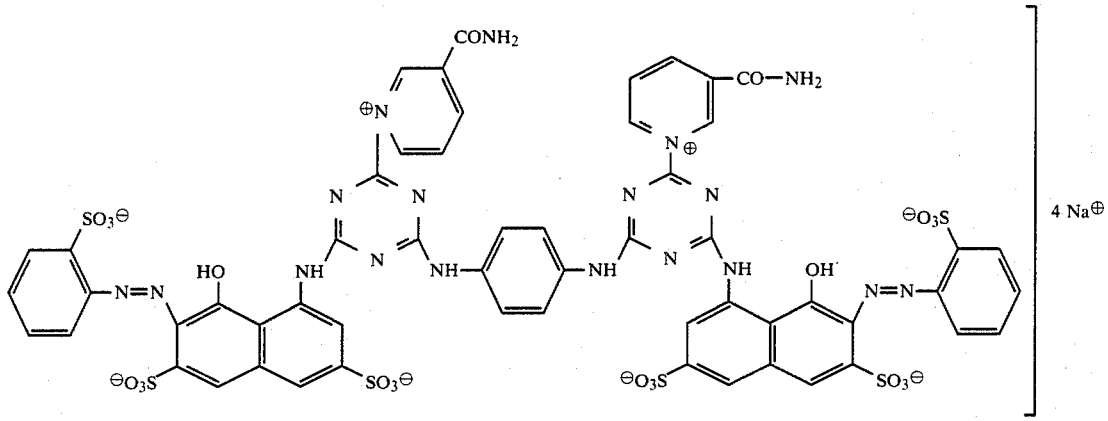

The dyebath is brought to pH 6.5 by addition of sodium phosphate. This dyebath is entered at 40° C. with 12 parts of a mercerized cotton fabric; the temperature is raised in the course of 10 minutes to 95°-100° C.; and dyeing is carried out at that temperature for 45 minutes. The fabric is then rinsed with cold and hot water and is soaped off at the boil for 10 minutes with a nonionic detergent. The result obtained is a deep, brilliant red dyeing which is very resistant to wash treatments and the effect of light.

EXAMPLE 44

(comparative example)

A dyebath is prepared to comprise 250 parts of water, 20 parts of sodium sulfate and 0.5 part of the dye of the formula

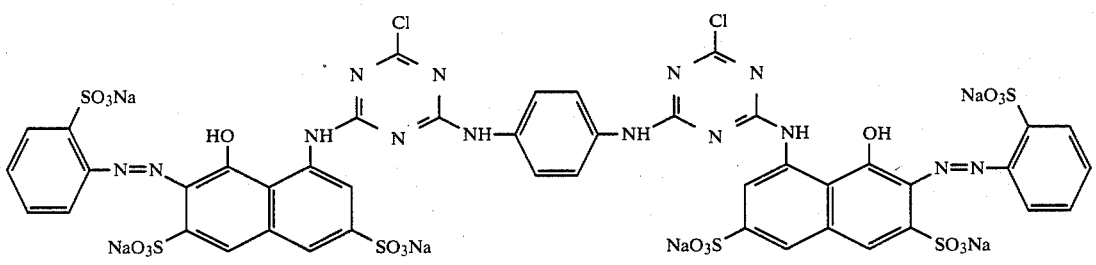

The dyebath is brought to pH 6.5 by addition of sodium phosphate. This dyebath is entered at 40° C. with 12 parts of a mercerized cotton fabric; the temperature is raised in the course of 10 minutes to 95°-100° C. and dyeing is carried out at that temperature for 45 minutes. The fabric is then rinsed with cold and hot water and is soaped off at the boil for 10 minutes. The cotton fabric thus obtained is dyed pale pink.

The example shows that the dye which contains the chlorotriazinyl group is practically not fixed to the fiber material in the absence of an acid-binding agent.

EXAMPLE 45

To 100 parts of a blend fabric of 50 parts of viscose rayon staple and 50 parts of polyamide fibers are added on an HT reel beck a warm liquor at 70° C. comprising 2000 parts of water, 6 parts of sodium m-nitrobenzenesulfonate, 50 parts of sodium sulfate and 3 parts of the dye of the formula

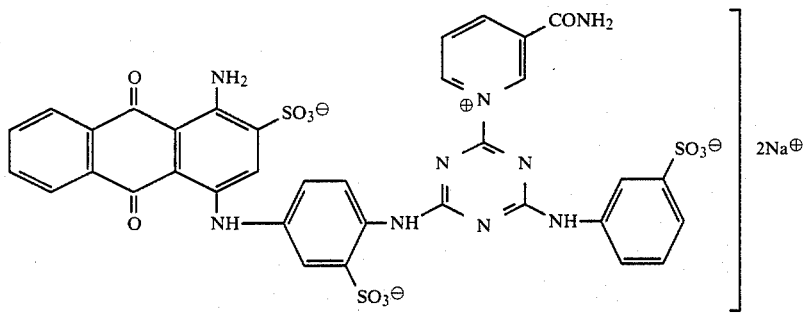

The liquor is raised to 110° C. with rapid circulation and is left at that temperature for 1 hour. The residual liquor is then discharged, and the fabric is rinsed and soaped off at the boil for 10 minutes.

The result obtained is an even blue dyeing on both fiber components.

We claim:

1. A process for dyeing cellulose fibers of cellulose blend fibers, which comprises dyeing the fibers mentioned with water-soluble reactive dyes which contain in the dye molecule, as the only fiber-reactive group or groups in the dye molecule, at least once the structural element of the formula

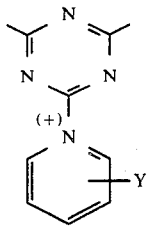

(1)

in which Y denotes a hydroxyl, hydroxymethyl, alkoxy $C_1$–$C_4$, aldehyde, carboxamide, monoalkyl $C_1$–$C_4$-carboxamide, dialkyl $C_1$–$C_4$-carboxamide, monophenyl carboxamide, cyano, alkyl $C_1$–$C_4$-oxycarbonyl or sulfo group or a halogen atom, in an aqueus medium within the pH range 4–11.

2. The process as claimed in claim 1, wherein the cellulose fibers are dyed alone or in mixture with synthetic polyamide fibers, silk or wool by the exhaust method at temperatures of about 30°–90° C. or by the padding method at temperatures of about 20°–50° C. with subsequent fixation of reactive dyes with or without heating.

3. The process as claimed in claim 1, wherein cellulose fibers blended with polyester fibers or cellulose triacetate fibers are dyed by a one-bath method within the pH range 5–8 and at a temperature of 95°–150° C. in the presence of disperse dyes.

4. The process as claimed in claim 1, wherein cellulose fibers blended with acid-modified acrylic fibers are dyed in the presence of cationic dyes.

5. The process as claimed in claim 1, wherein water-soluble reactive dyes from the series of the monoazo, polyazo, metal complex azo, formazan, anthraquinone, phthalocyanine, dioxazine, phenazine, azomethine or xanthene dyes are used.

6. The process as claimed in claim 1, wherein water-soluble reactive dyes of the general formula

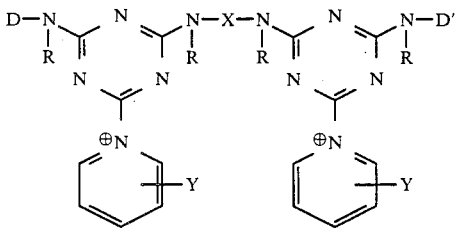

in which D, D′ represent radicals of a dye of the monoazo, polyazo, metal complex azo, formazan, anthraquinone or dioxazine series, it being possible for D and D′ to be identical or different, R denotes a hydrogen atom or an alkyl $C_1$–$C_4$ group, X denotes the radical of a diamine of the formula

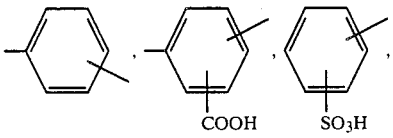

-continued

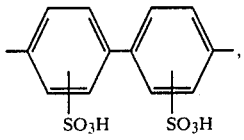

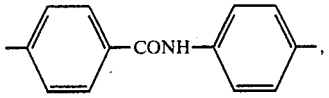

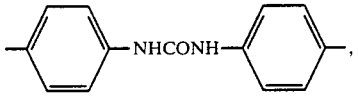

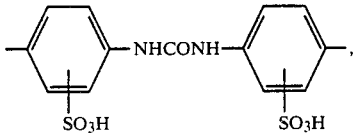

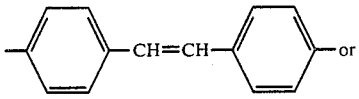

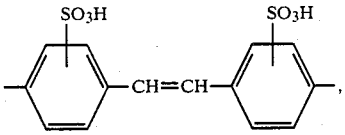

and Y has the meanings mentioned in claim 1, are used.

7. A process for dyeing cellulose fibers or cellulose blend fibers, which comprises dyeing the said fibers with water soluble fiber-reactive dyes dissolved in an aqueous dyeing medium having a pH within the range of 4 to 11, the dye molecules of said fiber-reactive dyes having at least one fiber-reactive group, each said fiber-reactive group being only a triazinyl-substituted pyridinium structural element of the formula

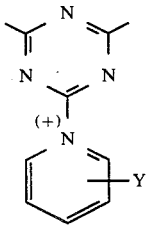

(1)

in which Y denotes a substituent of said structural element which enables the structural element to provide a dye fixation optimum under generally neutral conditions, Y being (a) sulfo or (b) hydroxyl, hydroxymethyl, $C_1$–$C_4$ alkoxy, aldehyde, carboxamide or carboxamide substituted by one or two $C_1$–$C_4$ alkyl groups or one phenyl group, cyano, a halogen atom, or alkyl $C_1$–$C_4$ oxycarbonyl.

8. The process as claimed in claim 7, wherein cellulose fibers blended with polyester fibers or cellulose triacetate fibers are dyed by a one-bath method within the pH range 5–8 and at a temperature of 95°–150° C. in the presence of disperse dyes.

9. The process as claimed in claim 1, wherein water-soluble reactive dyes are used which have the formula

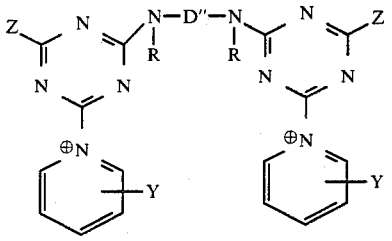

in which D″ denotes the radical of a dye of the disazo, polyazo, metal complex azo, formazan, metal phthalocyanine or dioxazine series, Z denotes an unsubstituted or substituted amino, alkoxy or phenoxy group, Y denotes a hydroxyl, hydroxymethyl, alkoxy $C_1$–$C_4$, aldehyde, carboxamide, monoalkyl $C_1$–$C_4$-carboxamide, dialkyl $C_1$–$C_4$-carboxamide, monophenyl carboxamide, cyano, alkyl $C_1$–$C_4$-oxycarbonyl or sulfo group or a halogen atom, and R is hydrogen or a $C_1$–$C_4$ alkyl group.

10. The process as claimed in claim 1, wherein a water-soluble reactive dye of the formula of claim 1, in which Y denotes the carboxamide, monoalkyl $C_1$–$C_4$-carboxamide, dialkyl $C_1$–$C_4$-carboxamide or monophenylcarboxamide group in the 3- or 4-position, is used.

11. The process as claimed in claim 1, wherein a water-soluble reactive dye is used which has the formula

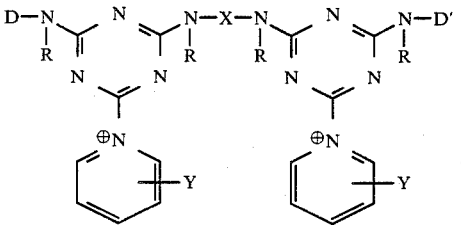

in which D, D′ represent radicals of a dye of the monoazo, polyazo, metal complex azo, formazan, anthraquinone or dioxazine series, it being possible for D and D′ to be identical or different, R denotes a hydrogen atom or an alkyl $C_1$–$C_4$ group, X denotes the radical of a diamine of the formula

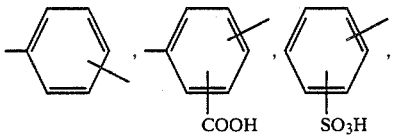

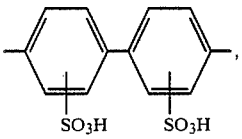

-continued

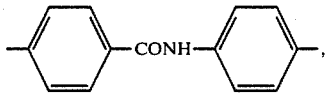

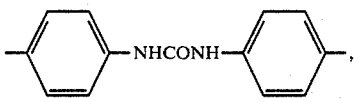

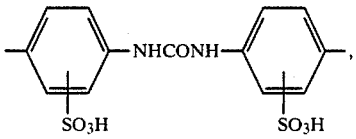

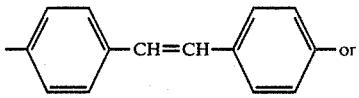

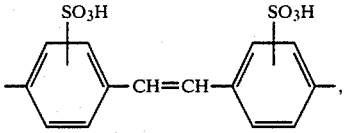

and Y denotes the carboxamide, monoalkyl $C_1$–$C_4$-carboxamide, dialkyl $C_1$–$C_4$-carboxamide or monophenylcarboxamide group in the 3- or 4-position.

12. The process as claimed in claim 1, wherein a water-soluble reactive dye is used which has the formula

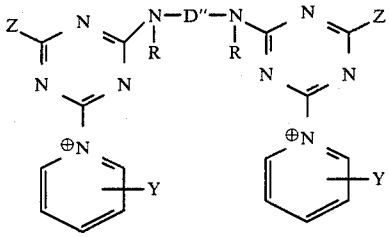

in which D″ denotes the radical of a dye of the disazo, polyazo, metal complex azo, formazan, metal phthalocyanine or dioxazine series, Z denotes an unsubstituted or substituted amino, alkoxy or phenoxy group, R denotes a hydrogen atom or a $C_1$–$C_4$ alkyl group, Y denotes the carboxamide, monoalkyl $C_1$–$C_4$-carboxamide, dialkyl $C_1$–$C_4$-carboxamide or monophenylphenylcarboxamide group in the 3- or 4-position.

13. The process as claimed in claim 1, wherein a water-soluble reactive dye of the formula of claim 1, in which Y denotes the methyloxycarbonyl or ethyloxycarbonyl group in the 3- or 4-position, is used.

14. The process as claimed in claim 1, wherein a water-soluble reactive dye is used which has the formula

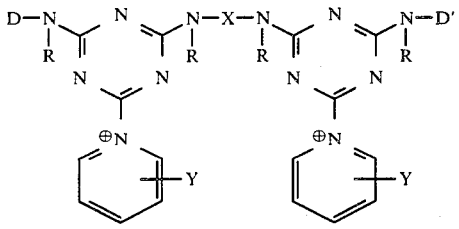

in which D, D' represent radicals of a dye of the monoazo, polyazo, metal complex azo, formazan, anthraquinone or dioxazine series, it being possible for D and D' to be identical or different, R denotes a hydrogen atom or an alkyl $C_1$–$C_4$ group, X denotes the radical of a diamine of the formula

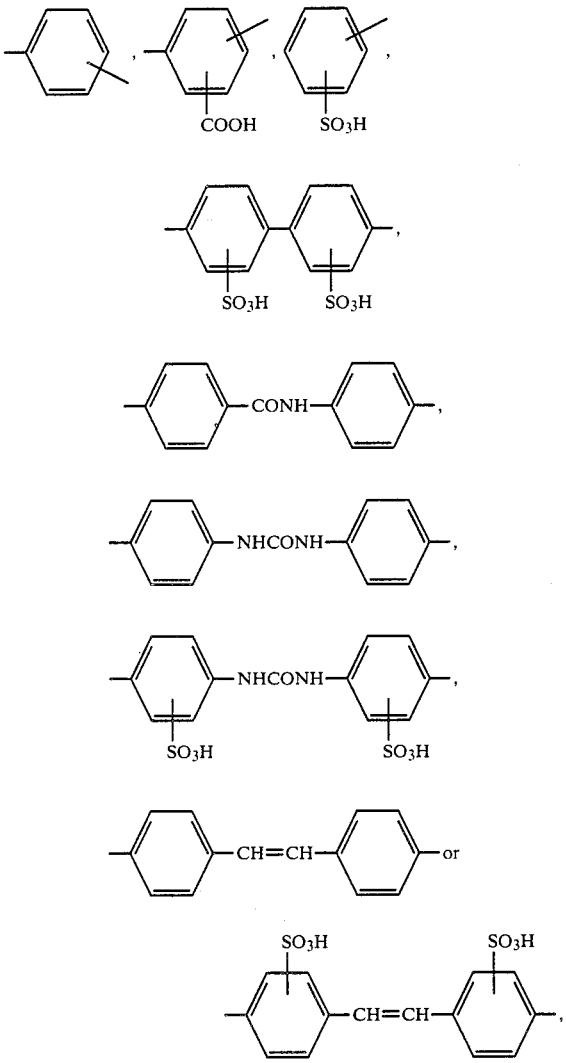

and Y denotes the methyloxycarbonyl or ethyloxycarbonyl group in the 3- or 4-position.

15. The process as claimed in claim 1, wherein a water-soluble reactive dye is used which has the formula

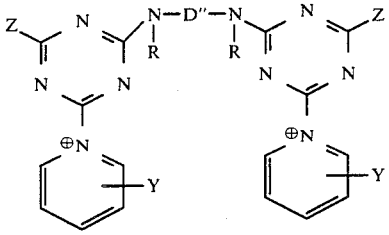

in which D'' denotes the radical of a dye of the disazo, polyazo, metal complex azo, formazan, metal phthalocyanine or dioxazine series, Z denotes an unsubstituted or substituted amino, alkoxy or phenoxy group, R denotes a hydrogen atom or a $C_1$–$C_4$ alkyl group, Y denotes the methyloxycarbonyl or ethyloxycarbonyl group in the 3- or 4-position.

16. The process as claimed in claim 1, wherein a water-soluble reactive dye of the formula of claim 1, in which Y denotes the sulfo group in the 3-position, is used.

17. The process as claimed in claim 1, wherein a water-soluble reactive dye is used, which has the formula

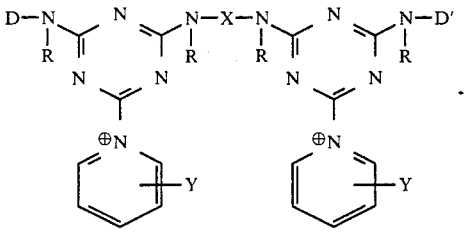

in which D, D' represent radicals of a dye of the monoazo, polyazo, metal complex azo, formazan, anthraquinone or dioxazine series, it being possible for D and D' to be identical or different, R denotes a hydrogen atom or an alkyl $C_1$–$C_4$ group, X denotes the radical of a diamine of the formula

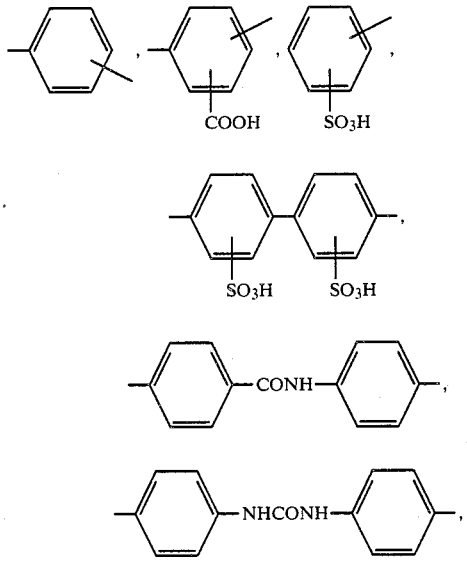

-continued

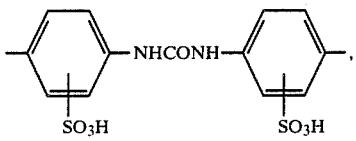

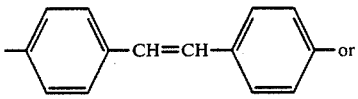

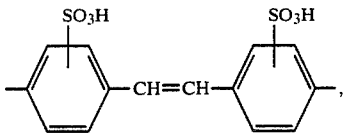

and Y denotes the sulfo group in 3-position.

18. The process as claimed in claim 1, wherein a water-soluble reactive dye is used which has the formula

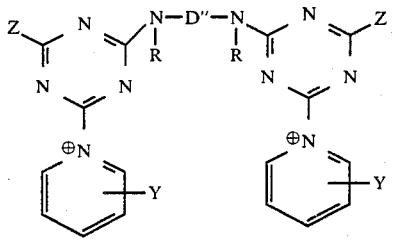

in which D" denotes the radical of a dye of the disazo, polyazo, metal complex azo, formazan, metal phthalocyanine or dioxazine series, Z denotes an unsubstituted or substituted amino, alkoxy or phenoxy group, R denotes a hydrogen atom or a $C_1$–$C_4$ alkyl group, Y denotes the sulfo group in the 3-position.

* * * * *

UNITED STATES PATENT AND TRADEMARK OFFICE

CERTIFICATE OF CORRECTION

PATENT NO. : 4,693,726

DATED : SEPTEMBER 15, 1987

INVENTOR(S) : MEININGER ET AL

It is certified that error appears in the above-identified patent and that said Letters Patent is hereby corrected as shown below:

Example 10 should read,

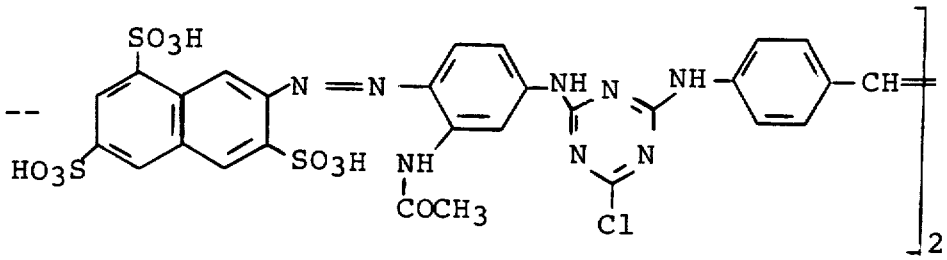

Example 11 should read,

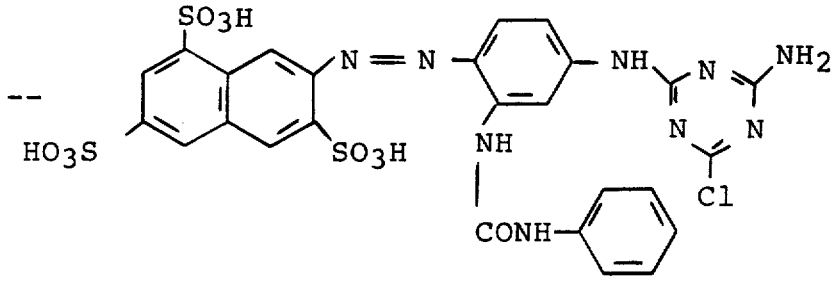

Example 12 should read,

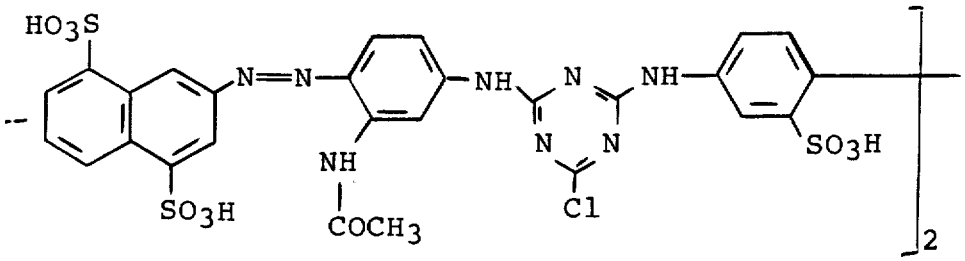

UNITED STATES PATENT AND TRADEMARK OFFICE

CERTIFICATE OF CORRECTION

PATENT NO. : 4,693,726

DATED : SEPTEMBER 15, 1987

INVENTOR(S) : MEININGER ET AL

It is certified that error appears in the above-identified patent and that said Letters Patent is hereby corrected as shown below:

Example 13 should read,

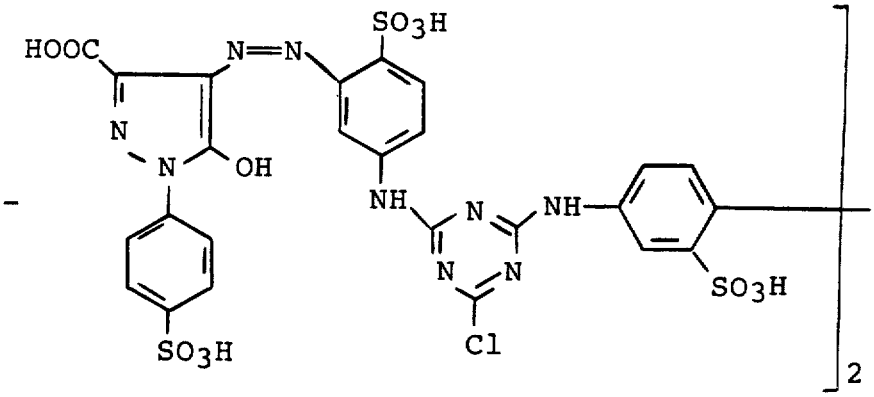

Example 14 should read,

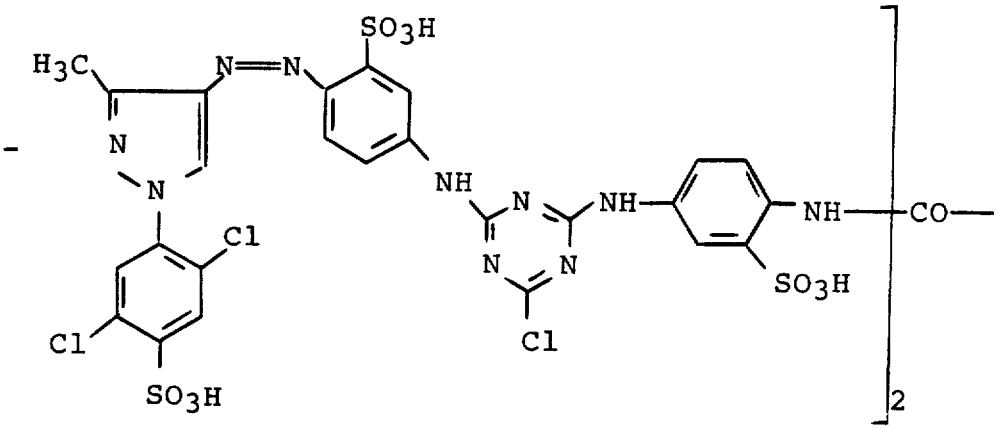

UNITED STATES PATENT AND TRADEMARK OFFICE

CERTIFICATE OF CORRECTION

PATENT NO. : 4,693,726

DATED : SEPTEMBER 15, 1987

INVENTOR(S) : MEININGER ET AL

It is certified that error appears in the above-identified patent and that said Letters Patent is hereby corrected as shown below:

Example 15 should read,

--

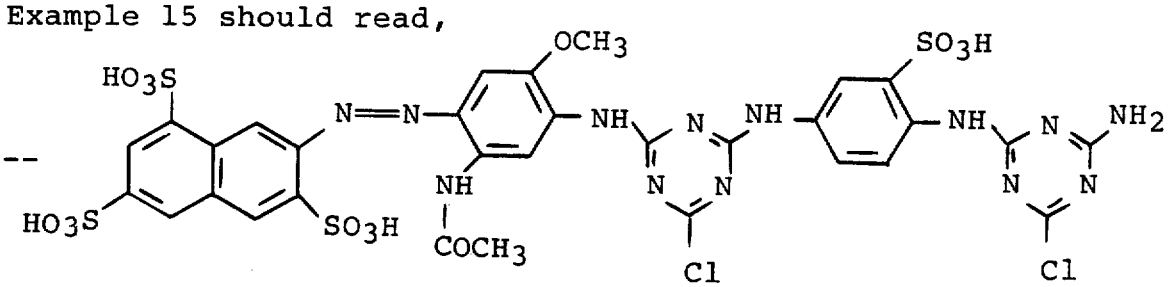

--

Example 16 should read,

--

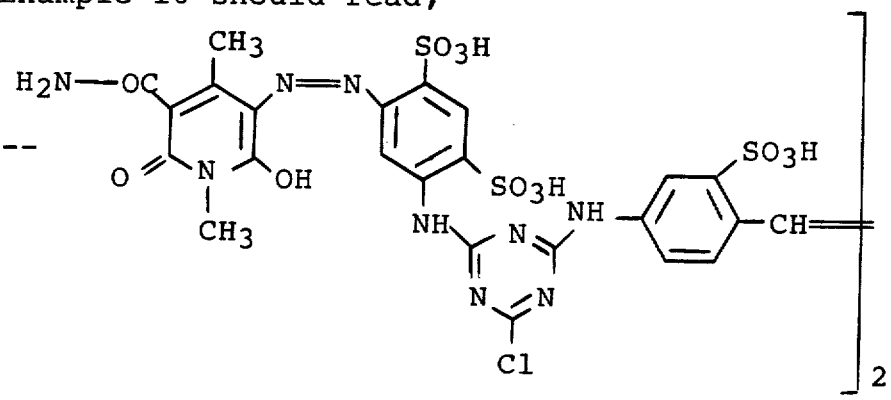

--

UNITED STATES PATENT AND TRADEMARK OFFICE

CERTIFICATE OF CORRECTION

PATENT NO. : 4,693,726

DATED : SEPTEMBER 15, 1987

INVENTOR(S) : MEININGER ET AL

It is certified that error appears in the above-identified patent and that said Letters Patent is hereby corrected as shown below:

Example 17 should read,

--

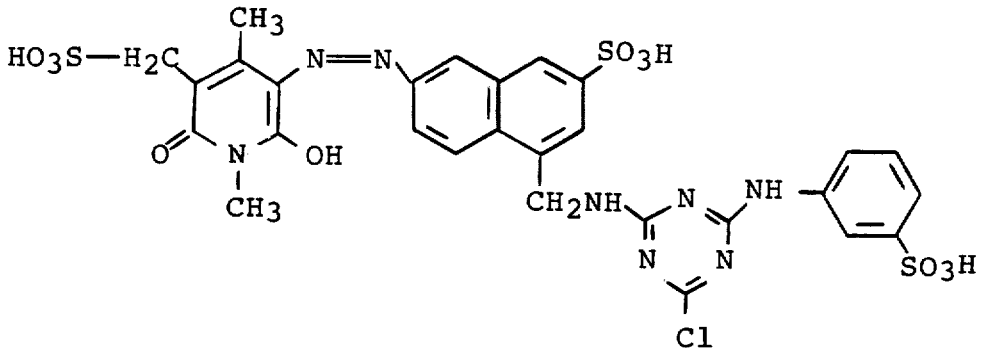

--

Example 18 should read,

--

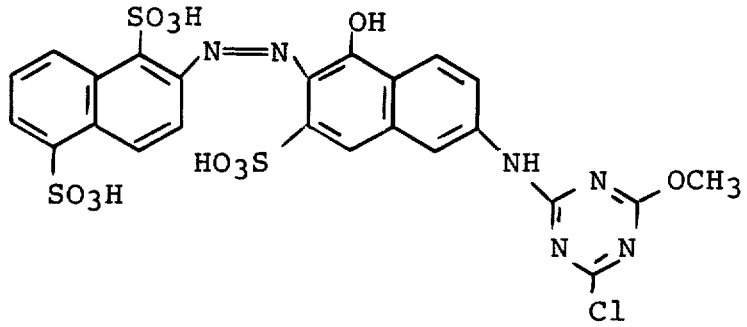

--

UNITED STATES PATENT AND TRADEMARK OFFICE

CERTIFICATE OF CORRECTION

PATENT NO. : 4,693,726

DATED : SEPTEMBER 15, 1987

INVENTOR(S) : MEININGER ET AL

It is certified that error appears in the above-identified patent and that said Letters Patent is hereby corrected as shown below:

Example 19 should read,

--

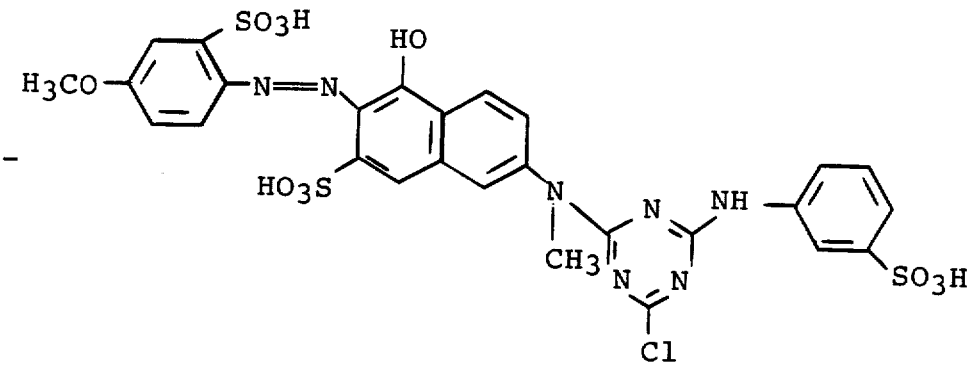

--

Example 20 should read,

--

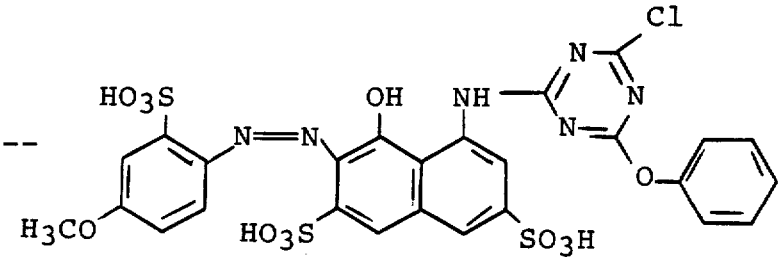

--

UNITED STATES PATENT AND TRADEMARK OFFICE

CERTIFICATE OF CORRECTION

PATENT NO. : 4,693,726

DATED : SEPTEMBER 15, 1987

INVENTOR(S) : MEININGER ET AL

It is certified that error appears in the above-identified patent and that said Letters Patent is hereby corrected as shown below:

Example 21 should read,

--

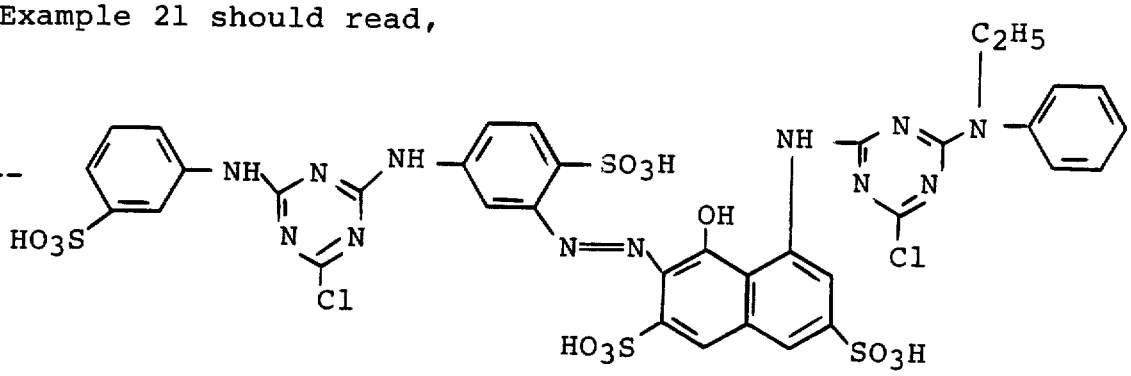

--

Example 22 should read,

--

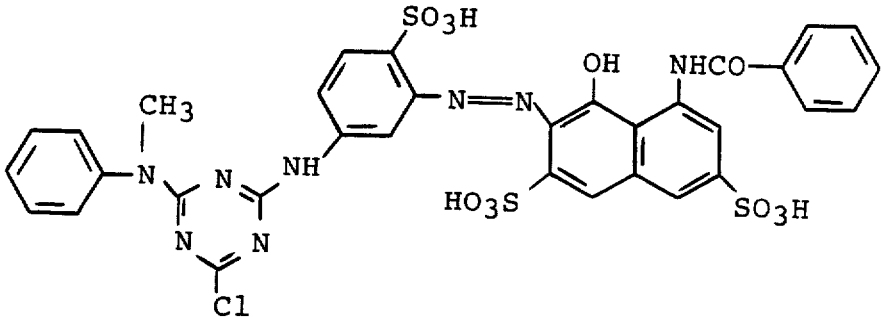

--

UNITED STATES PATENT AND TRADEMARK OFFICE

CERTIFICATE OF CORRECTION

PATENT NO. : 4,693,726

DATED : SEPTEMBER 15, 1987

INVENTOR(S) : NEININGER ET AL

It is certified that error appears in the above-identified patent and that said Letters Patent is hereby corrected as shown below:

Example 23 should read,

--

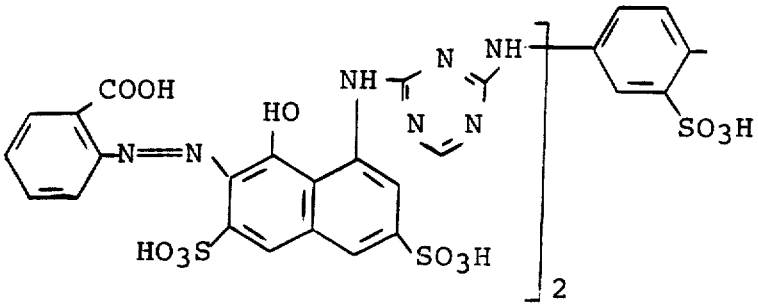

--

Example 24 should read,

--

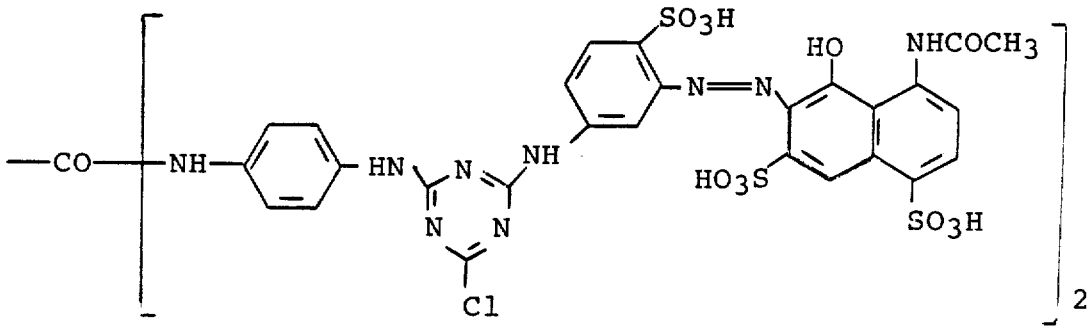

--

UNITED STATES PATENT AND TRADEMARK OFFICE

CERTIFICATE OF CORRECTION

PATENT NO. : 4,693,726

DATED : SEPTEMBER 15, 1987

INVENTOR(S) : MEININGER ET AL

It is certified that error appears in the above-identified patent and that said Letters Patent is hereby corrected as shown below:

Example 25 should read,

--

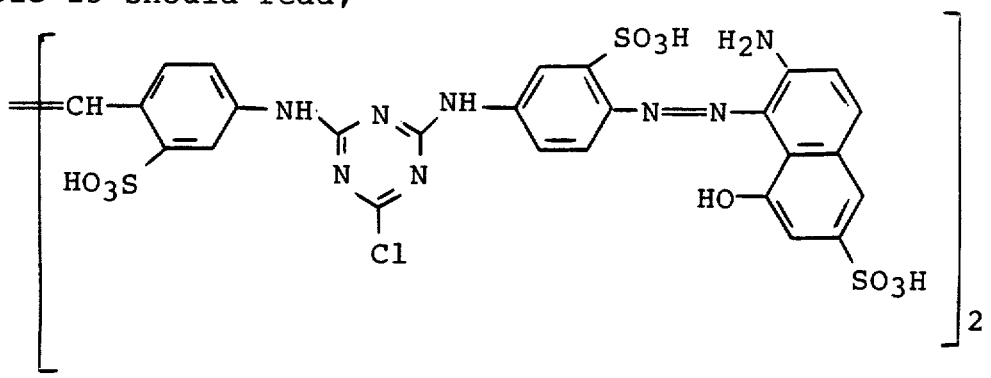

--

Example 26 should read,

--

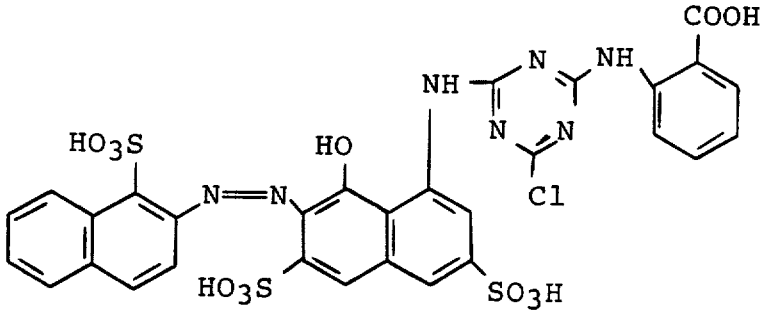

--

UNITED STATES PATENT AND TRADEMARK OFFICE

CERTIFICATE OF CORRECTION

PATENT NO. : 4,693,726

DATED : SEPTEMBER 15, 1987

INVENTOR(S) : MEININGER ET AL

It is certified that error appears in the above-identified patent and that said Letters Patent is hereby corrected as shown below:

Example 27 should read,

--

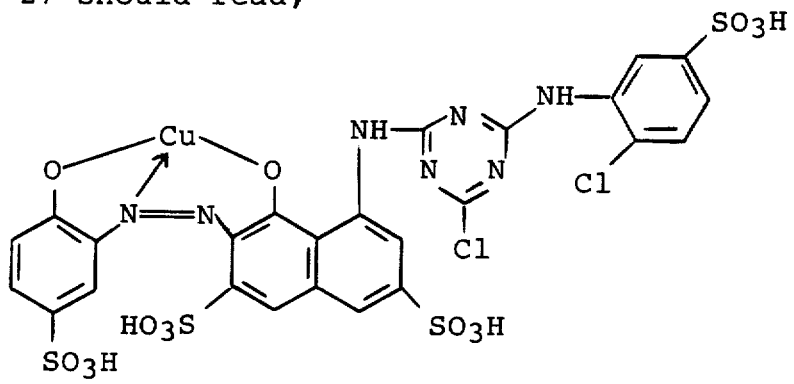

--

Example 28 should read,

--

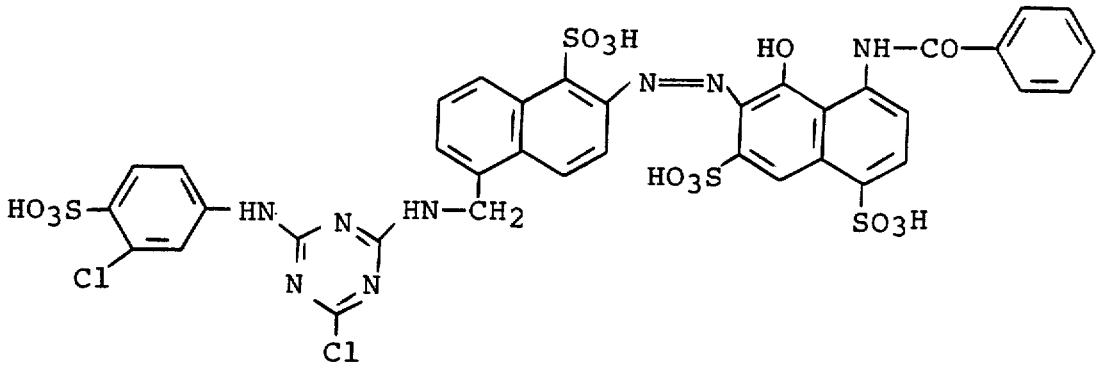

--

UNITED STATES PATENT AND TRADEMARK OFFICE

CERTIFICATE OF CORRECTION

PATENT NO. : 4,693,726

DATED : SEPTEMBER 15, 1987

INVENTOR(S) : MEININGER ET AL

It is certified that error appears in the above-identified patent and that said Letters Patent is hereby corrected as shown below:

Example 29 should read,

--

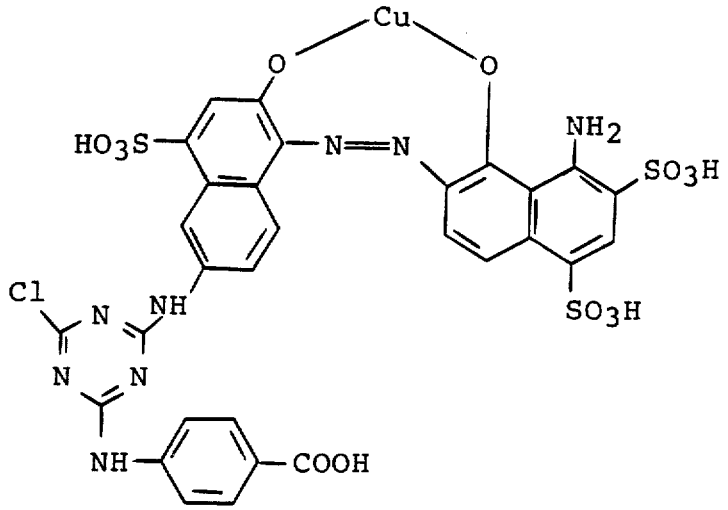

--

Example 30 should read,

--

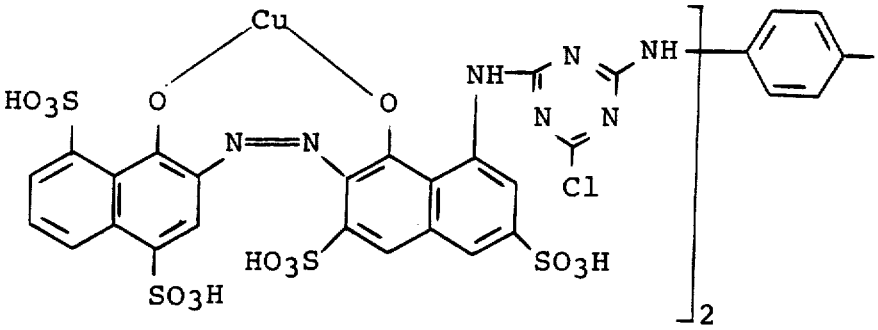

--

UNITED STATES PATENT AND TRADEMARK OFFICE

CERTIFICATE OF CORRECTION

PATENT NO. : 4,693,726

DATED : SEPTEMBER 15, 1987

INVENTOR(S) : MEININGER ETAL

It is certified that error appears in the above-identified patent and that said Letters Patent is hereby corrected as shown below:

Example 32 should read,

--

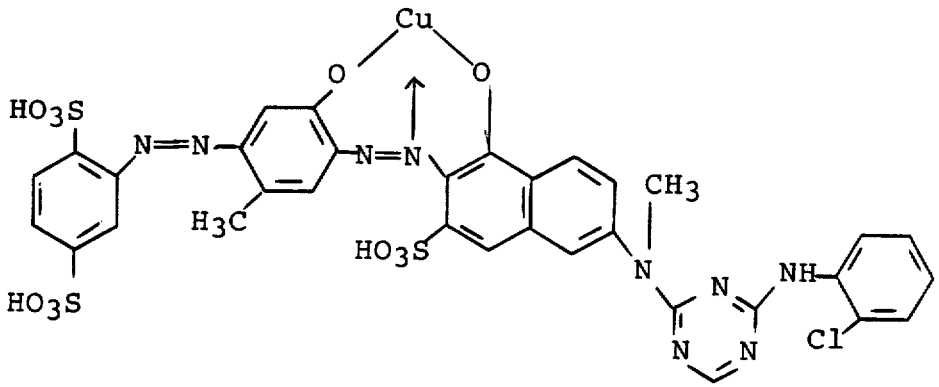

--

UNITED STATES PATENT AND TRADEMARK OFFICE

CERTIFICATE OF CORRECTION

PATENT NO. : 4,693,726

DATED : SEPTEMBER 15, 1987

INVENTOR(S) : MEININGER ET AL

It is certified that error appears in the above-identified patent and that said Letters Patent is hereby corrected as shown below:

Example 39 should read,

--

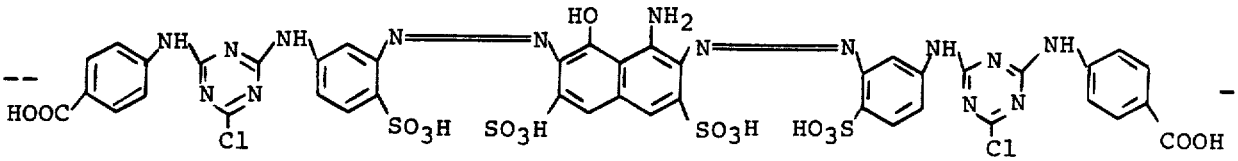

--

Example 40 should read,

--

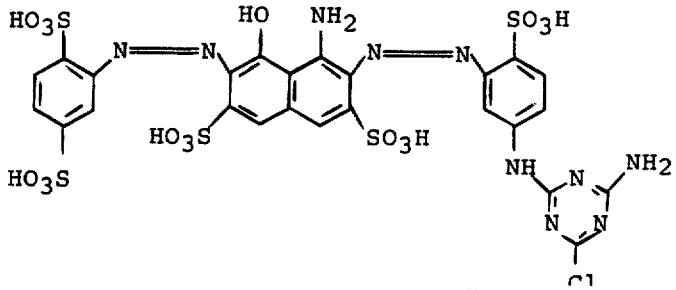

--

Signed and Sealed this

Twenty-first Day of March, 1989

*Attest:*

*Attesting Officer*

DONALD J. QUIGG

*Commissioner of Patents and Trademarks*